US006244685B1

(12) United States Patent
Yamada et al.

(10) Patent No.: US 6,244,685 B1
(45) Date of Patent: Jun. 12, 2001

(54) HEAD WIPING ARRANGEMENT FOR INK JET PRINTER

(75) Inventors: Akitoshi Yamada; Hiromitsu Hirabayashi; Akihiko Sukigara, all of Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/070,743

(22) Filed: May 1, 1998

(51) Int. Cl.[7] ..... B41J 2/165
(52) U.S. Cl. ..... 347/33; 347/22
(58) Field of Search ..... 347/33, 32, 22, 347/20

(56) References Cited

U.S. PATENT DOCUMENTS

| | | | | |
|---|---|---|---|---|
| 5,103,244 | | 4/1992 | Gast et al. . | |
| 5,396,277 | * | 3/1995 | Gast et al. | 347/33 |
| 5,398,054 | * | 3/1995 | Fukazawa et al. | 347/33 |
| 5,612,722 | | 3/1997 | Francis et al. | 347/33 |
| 5,706,038 | | 1/1998 | Jackson et al. | 347/33 |
| 5,710,581 | | 1/1998 | Barton et al. | 347/35 |
| 5,798,775 | * | 8/1998 | Takahashi et al. | 347/33 |
| 5,898,445 | * | 4/1999 | Becker et al. | 347/33 |
| 5,905,514 | * | 5/1999 | Rhoads et al. | 347/33 |
| 5,942,043 | * | 8/1999 | Suemune | 134/18 |
| 5,953,025 | * | 9/1999 | Sakurai | 347/33 |
| 5,963,229 | * | 10/1999 | Fukuoka | 347/33 |

FOREIGN PATENT DOCUMENTS

| | | |
|---|---|---|
| 383019 | 8/1990 | (EP) . |
| 510894 | 10/1992 | (EP) . |
| 552472 | 7/1993 | (EP) . |
| 589604 | 3/1994 | (EP) . |
| 709204 | 5/1996 | (EP) . |
| 829359 | 3/1998 | (EP) . |
| 59-14963 | 1/1984 | (JP) . |

* cited by examiner

*Primary Examiner*—Robert Beatty
(74) *Attorney, Agent, or Firm*—Fitzpatrick, Cella, Harper & Scinto

(57) ABSTRACT

A system to perform a wiping operation upon an ink jet print head includes a first motion of the ink jet print head in a first direction to wipe the ink jet print head against a wiping element, and a second motion of the ink jet print head in the first direction to wipe the ink jet print head against the wiping element. A system to wipe an ink jet print head also includes a first motion of the ink jet print head in a first direction against a wiping element to wipe the ink jet print head, and ejection of ink toward the wiping element during the first motion. The wiping element may be a non-planar wave wiper.

57 Claims, 34 Drawing Sheets

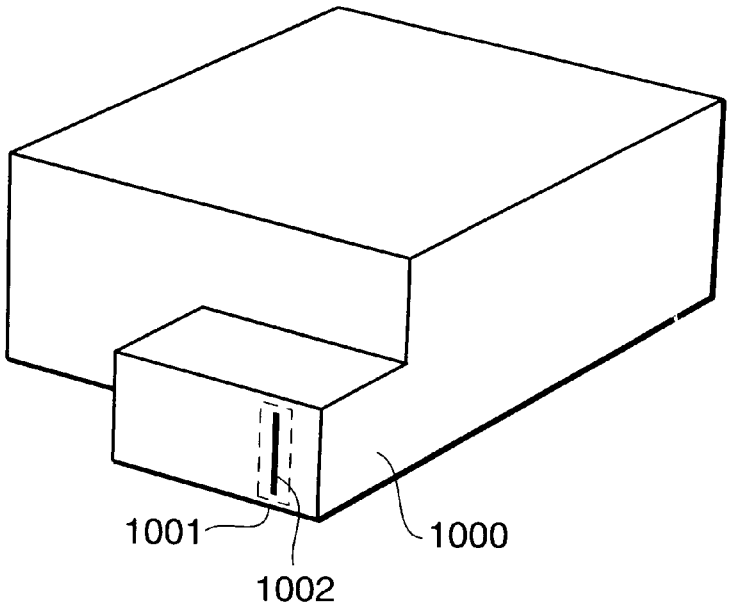
FIG. 1a
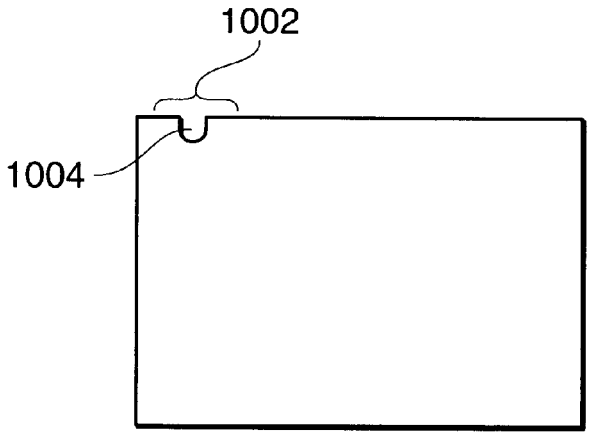
FIG. 1b
FIG. 1

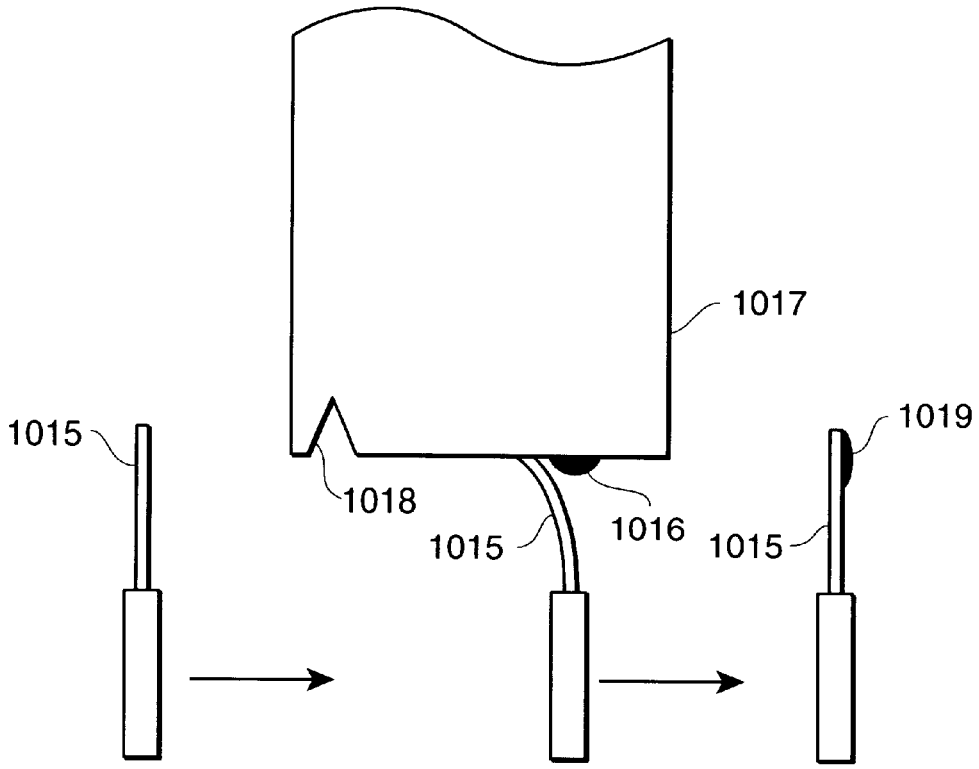
FIG. 3a
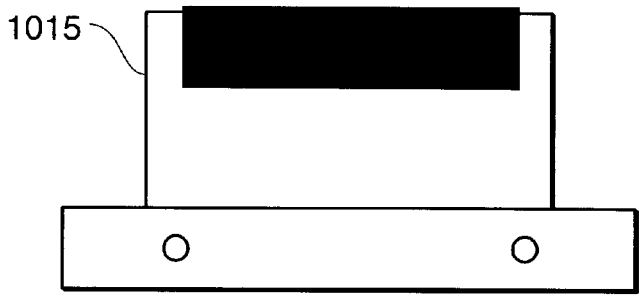
FIG. 3b
FIG. 3

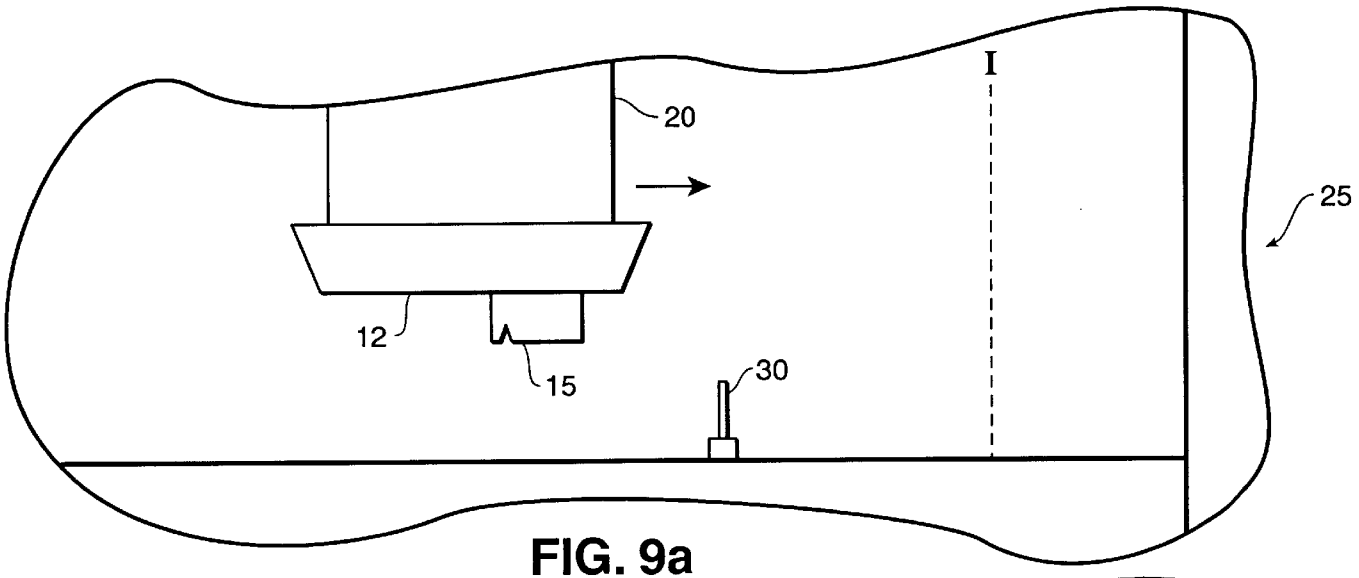
FIG. 9a
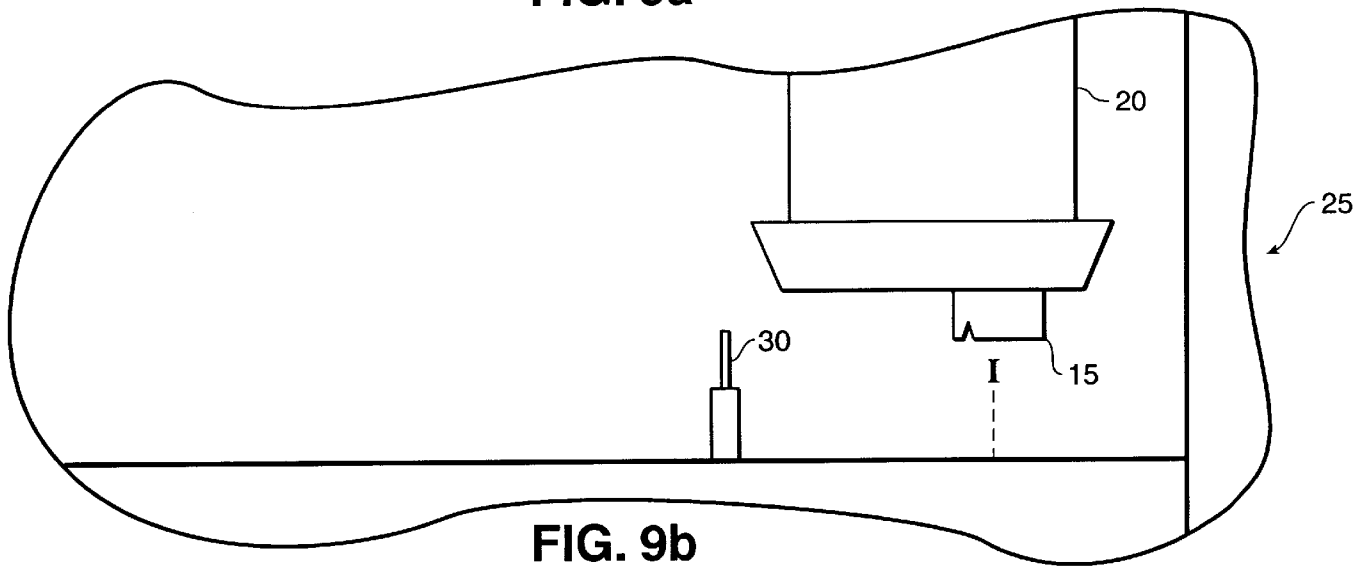
FIG. 9b
| |
|---|
| FIG. 9a |
| FIG. 9b |
| FIG. 9c |
| FIG. 9d |
FIG. 9

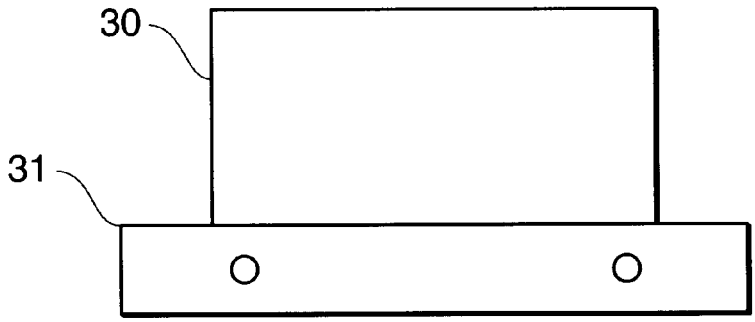
FIG. 10a
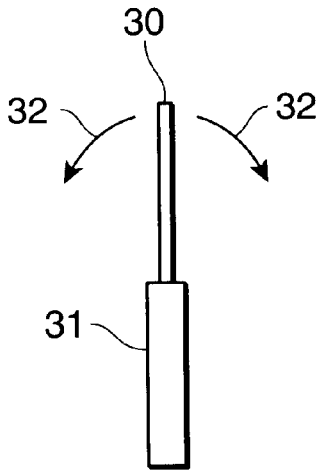
FIG. 10b
FIG. 10

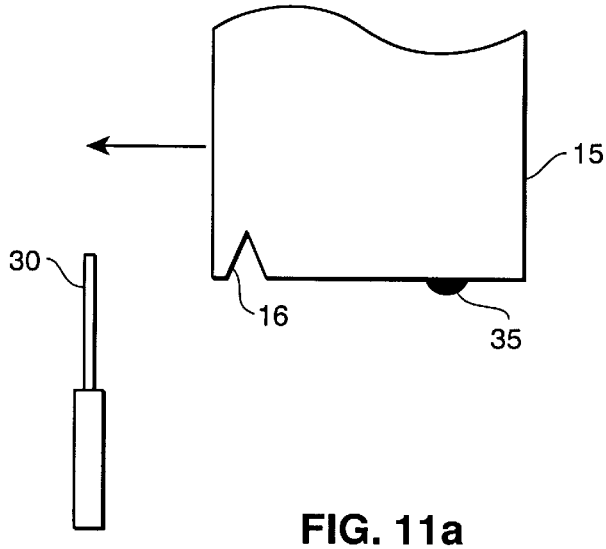
FIG. 11a
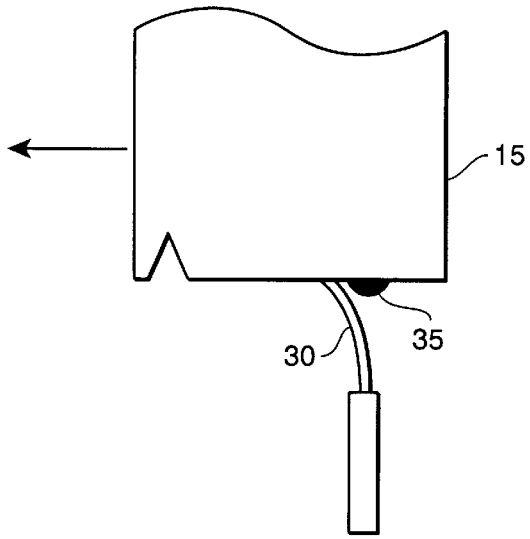
FIG. 11b
| |
|---|
| FIG. 11a |
| FIG. 11b |
| FIG. 11c |
| FIG. 11d |
| FIG. 11e |
| FIG. 11f |
FIG. 11
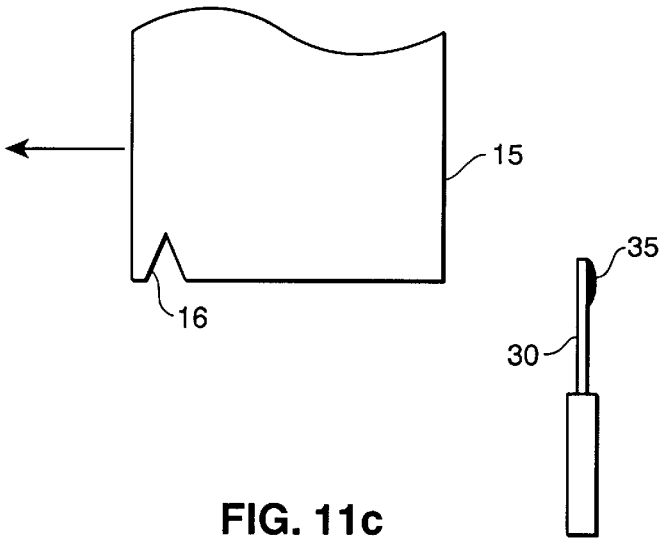
FIG. 11c

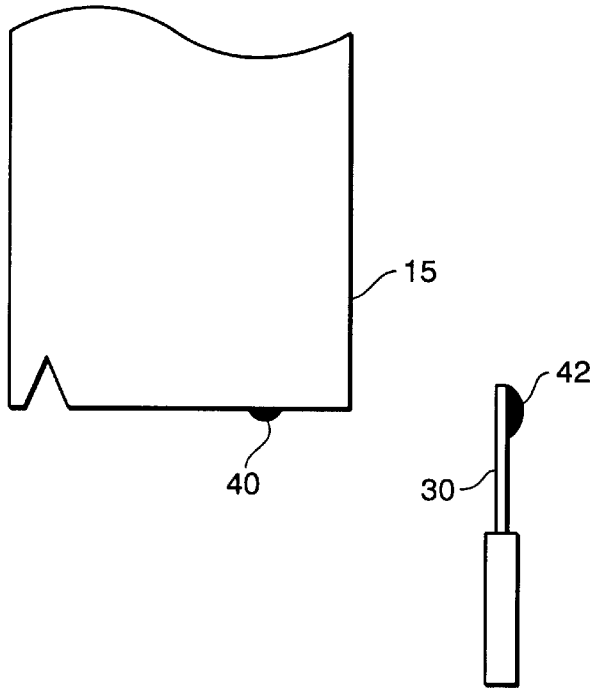
FIG. 14a
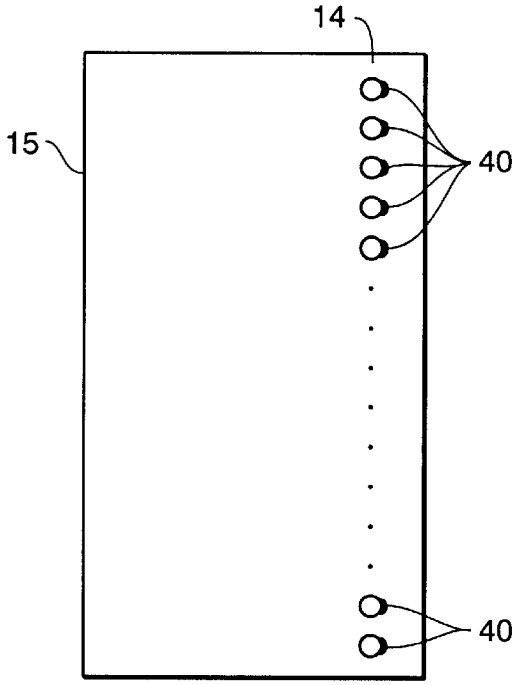
FIG. 14b
FIG. 14

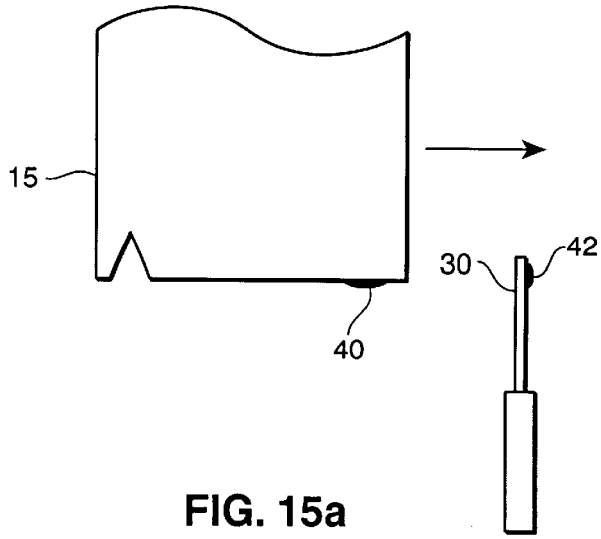
FIG. 15a
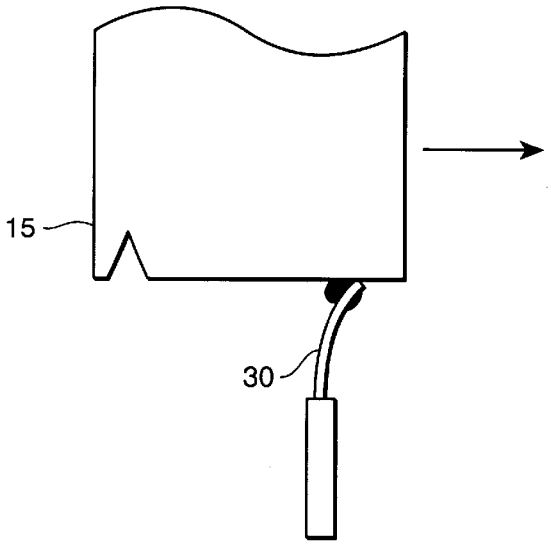
FIG. 15
FIG. 15b
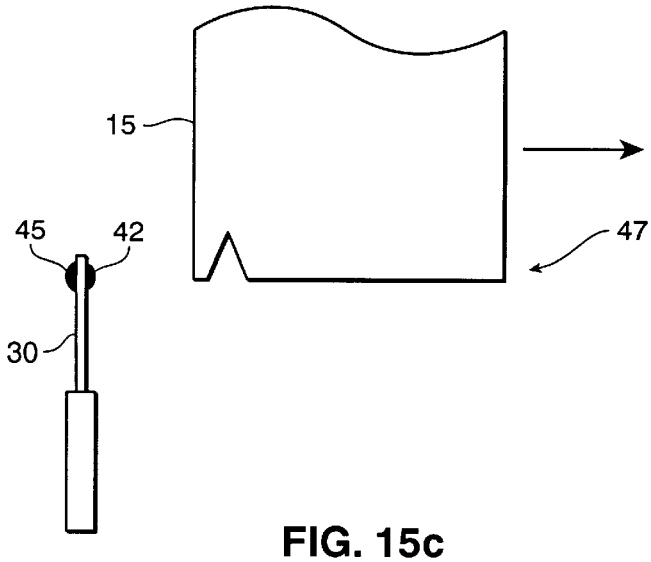
FIG. 15c

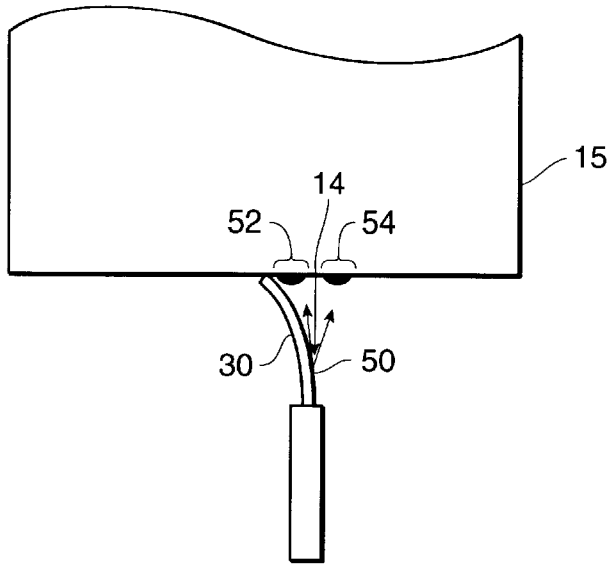
FIG. 18a
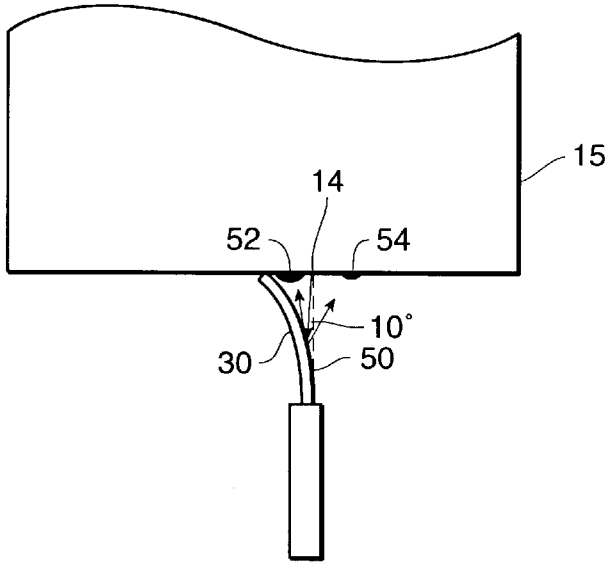
FIG. 18b
| |
|---|
| FIG. 18a |
| FIG. 18b |
| FIG. 18c |
| FIG. 18d |
FIG. 18

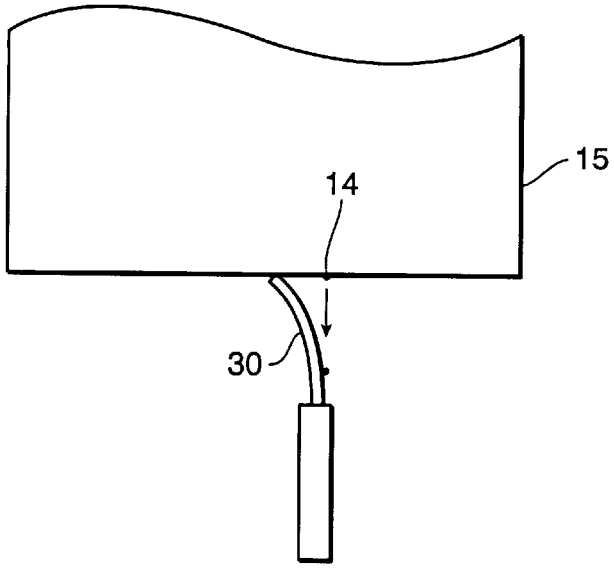
FIG. 21a
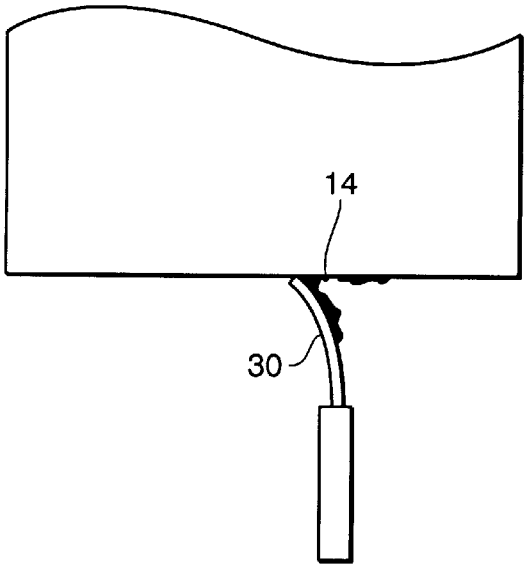
FIG. 21b
| |
|---|
| FIG. 21a |
| FIG. 21b |
| FIG. 21c |
| FIG. 21d |
| FIG. 21e |
FIG. 21

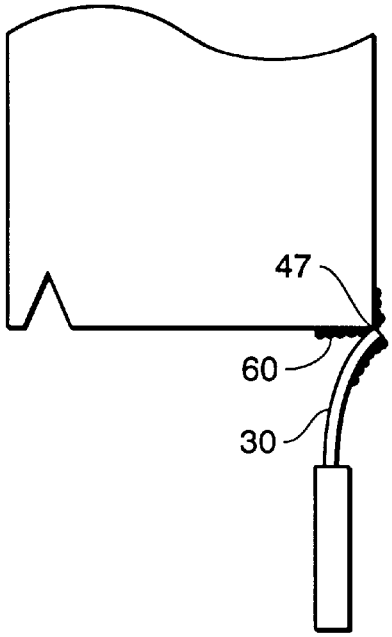
FIG. 23a
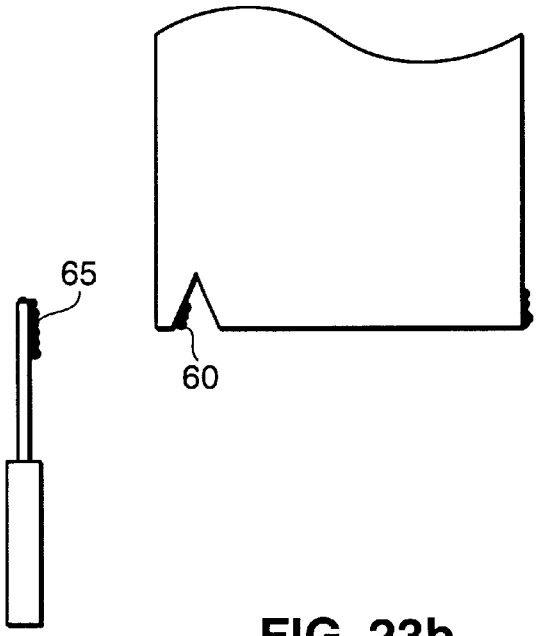
FIG. 23b
FIG. 23

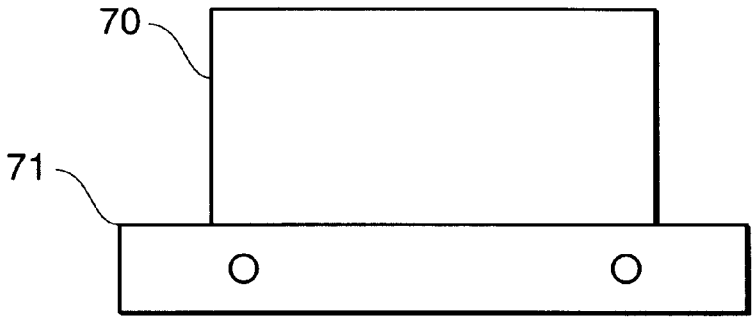
FIG. 25a
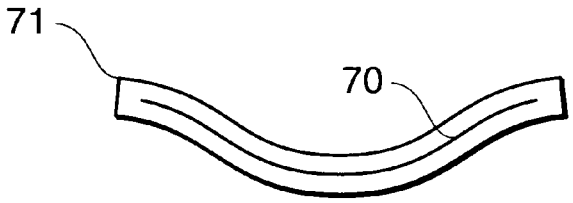
FIG. 25b
FIG. 25

| FIG. 28a |
| --- |
| FIG. 28b |

HEAD WIPING ARRANGEMENT FOR INK JET PRINTER

BACKGROUND OF THE INVENTION

1. Field of the Invention

The present invention relates to systems for cleaning an ink jet print head. More particularly, the present invention concerns a system for wiping ink from an ink jet print head before, during, or after a print job.

2. Description of the Related Art

Conventional ink jet printers utilize ink jet print heads to print images upon a recording medium. Ink jet print heads contain ink jet nozzles which eject ink droplets onto the recording medium through nozzle openings. Over time, ink collects on the print head nearby the nozzle openings, thereby tending to obstruct the openings.

Due to the foregoing, many conventional ink jet printers provide systems for cleaning ink from an ink jet print head before, during, or after printing using the ink jet print head. One such system is a wiping system, in which an element is moved across a nozzle-containing surface of a print head so as to wipe ink from the print head. More specifically, conventional wiping systems operate by dragging a flexible wiping element across an ink jet print head through relative motion between the wiping element and the print head.

However, conventional wiping systems have proved to be inadequate. In particular, conventional wiping systems, even when used in conjunction with other nozzle cleaning systems such as purging or sucking systems, leave an unsatisfactory amount of residual ink on the print head after wiping. Moreover, the amount of residual ink left behind after wiping increases with subsequent wiping.

Accordingly, what is needed is a system for effectively wiping ink away from a nozzle surface of an ink jet print head in which wiping effectiveness does not degrade significantly with use.

Special problems arise during wiping of "engraved" ink jet print heads. In this regard, FIG. 1*a* shows representative engraved print head 1000. As shown, nozzles 1001 are disposed linearly within nozzle surface 1002 of print head 1000. However, as shown in FIG. 1*b*, nozzles 1001 are disposed in groove 1004 within nozzle surface 1002. Accordingly, the openings of nozzles 1001 are not coplanar with the area of nozzle surface 1002 outside of groove 1004. In contrast, non-engraved print heads include nozzle openings which are generally coplanar with the surface of the print head. As can be understood from the foregoing, effective wiping of an engraved print head is difficult due to variations in the features of the print head along a nozzle surface.

Conventional systems have attempted to address this problem by utilizing two or more wipers of varying dimensions in order to wipe different areas of an engraved print head. FIG. 2 illustrates such a conventional scheme. As shown in FIG. 2, wiper blade 1006 is longer than groove 1004, while wiper blade 1007 is shorter than groove 1004. Accordingly, as illustrated in FIG. 2, wiper blade 1006 is used to wipe regions of nozzle surface 1002 which do not include groove 1004. On the other hand, wiper blade 1007 is used primarily to wipe groove 1004. Such multiple wiping systems, however, present mechanical problems due to the need to coordinate wiping using both wiper blades. Moreover, in a case that wiper blade 1007 initially passes over groove 1004, followed by wiper blade 1006, wiper blade 1006 tends to transfer ink from ledge 1011 into groove 1004.

Conversely, in a case that wiper blade 1006 is moved first across nozzle surface 1002, followed by wiper blade 1007, wiper blade 1006 gathers ink within groove 1004, and wiper blade 1007 proceeds to push the gathered ink onto ledges 1009 and 1010.

Another conventional attempt to address the foregoing difficulties in wiping an engraved print head utilizes a specially-shaped non-planar wiper intended to contact all of nozzle surface 1002, including groove 1004, during wiping. However, such wipers, as currently used, fail to adequately wipe either one or both regions.

Accordingly, what is also needed is a system for effectively wiping ink away from a nozzle surface of an ink jet print head which is capable of effectively wiping engraved ink jet print heads.

SUMMARY OF THE INVENTION

In view of the foregoing, the present Applicants have discovered that buildup of ink upon a wiping element contributes significantly to degradation of wiping effectiveness over time. In this regard, FIG. 3*a* illustrates a conventional wiping system. As shown in FIG. 3*a*, wiper blade 1015 moves relatively across ink jet nozzles 1016 of ink jet print head 1017. After wiping, ink wiped from print head 1017 is deposited as nodule 1019 upon wiper blade 1015. Applicants have discovered that because conventional systems allow nodule 1019 to dry, subsequent wipings fail to remove adequate amounts of nodule 1019 from wiper blade 1015, even despite scraping of nodule 1019 with wiper cleaner 1018 during subsequent wipings. Accordingly, wiper blade 1015 gradually collects solid ink deposits, as shown in FIG. 3*b*. These deposits reduce the effectiveness of wiping by presenting an uneven wiping surface to print head 1017 during wiping.

The present invention address the foregoing by wiping an ink jet print head having a wiper cleaner two consecutive times during a wiping sequence. By wiping an ink jet recording head twice, ink is not allowed to significantly harden upon a wiping element and is more effectively removed from the wiping element than with conventional wiping systems. As a result, the wiping element presents a more uniform surface to a print head during wiping and resulting wiping is more effective.

Therefore, in one aspect, the present invention is a system to perform a wiping operation upon an ink jet print head including a first motion of the ink jet print head in a first direction to wipe the ink jet print head against a wiping element, and a second motion of the ink jet print head in the first direction to wipe the ink jet print head against the wiping element.

By virtue of the foregoing aspect, wiping effectiveness increases. Moreover, a wiping element remains more free of ink than those of conventional systems, thereby providing more effective wiping over time.

Preferably, the system also includes a third motion of the ink jet print head in a second direction opposite to the first direction the third motion between the first and second motions to wipe the ink jet print head against the wiping element.

The foregoing preferred aspect also has the object of effectively wiping ink from an exceptionally wet print head, for example, after a purging operation.

Applicants have also discovered that wiping effectiveness is increased if ink located on a print head as well as on a wiping element is in a liquid state. The present invention utilizes this discovery by wetting an ink jet print head and a wiping element during a wiping process so as to more effectively wipe ink from the ink jet print head.

Therefore, in one aspect, the present invention is a system to wipe an ink jet print head including a first motion of the ink jet print head in a first direction against a wiping element to wipe the ink jet print head, and ejection of ink toward the wiping element during the first motion. In one preferred arrangement, ink ejected toward the wiping element deflects off of the wiping element and collects on the ink jet print head. The system also preferably includes control of the ejection based upon a shape of the wiping element during the first motion.

In a related aspect, the present invention also includes ejection of ink toward a top edge and a trailing surface of the wiper element during the first motion, and/or a second motion of the ink jet print head in a second direction opposite to the first direction to wipe the ink jet print head against the wiping element.

It should be noted that various combinations of the above aspects can be used during printer operation in order to ensure fast and effective wiping. In this regard, the present invention also relates to a system to wipe an ink jet print head in a printing apparatus, including setting of a wiping mode in the printing apparatus, and determination of a wiping procedure based on the set wiping mode.

The present invention also addresses the above-described problems by utilizing a non-planar wiping element to wipe an engraved ink jet print head in two opposite directions during a wiping sequence. As a result, both an grooved nozzle region and a surrounding nozzle region of a print head are effectively wiped.

In this regard, the present invention also relates to a system to wipe an engraved ink jet print head having ink jet nozzle openings disposed in a groove within a face of the ink jet print head, including motion of the ink jet print head in a first direction past a raised wave wiper so as to wipe the print head with a first side of the raised wave wiper, and motion of the ink jet print head in a second direction, opposite to the first direction, past the raised wave wiper so as to wipe the ink jet print head with a second side of the raised wave wiper. As a result of the foregoing aspect, the present invention provides effective wiping of an engraved ink jet print head.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

FIG. 1, comprising FIG. 1*a* and FIG. 1*b*, shows representative views of an engraved ink jet print head.

FIG. 3*a* is a view illustrating wiping of an ink jet print head.

FIG. 3*b* is a view illustrating ink accumulation upon a wiping element resulting from conventional wiping systems.

FIG. 9, comprising FIG. 9*a* to FIG. 9*d*, shows detailed views of a wiping sequence in accordance with one embodiment of the present invention.

FIG. 10, comprising FIG. 10*a* and FIG. 10*b*, shows perspective views of a wiping element for use in conjunction with the present invention.

FIG. 11, comprising FIG. 11*a* to FIG. 11*f*, illustrates a wiping sequence according to the present invention.

FIG. 14*a* illustrates an ink jet print head and a wiping element after a first wipe of a wiping sequence according to the present invention.

FIG. 14*b* is a perspective view of ink jet nozzle openings after a first wipe of a wiping sequence according to the present invention.

FIG. 15, comprising FIG. 15*a* to FIG. 15*c*, illustrates a wiping sequence according to the present invention.

FIG. 18, comprising FIG. 18*a* to FIG. 18*d*, illustrates wet wiping in accordance with the present invention.

FIG. 21, comprising FIG. 21*a* to FIG. 21*e*, illustrates wet wiping according to the FIG. 20 process steps.

FIG. 23, comprising FIG. 23*a* and FIG. 23*b*, illustrates a wiping sequence according to the FIG. 22 process steps.

FIG. 25, comprising FIG. 25*a* and FIG. 25*b*, shows perspective views of a wave wiper for use in accordance with the present invention.

DETAILED DESCRIPTION OF THE PREFERRED EMBODIMENTS

Figure 2:
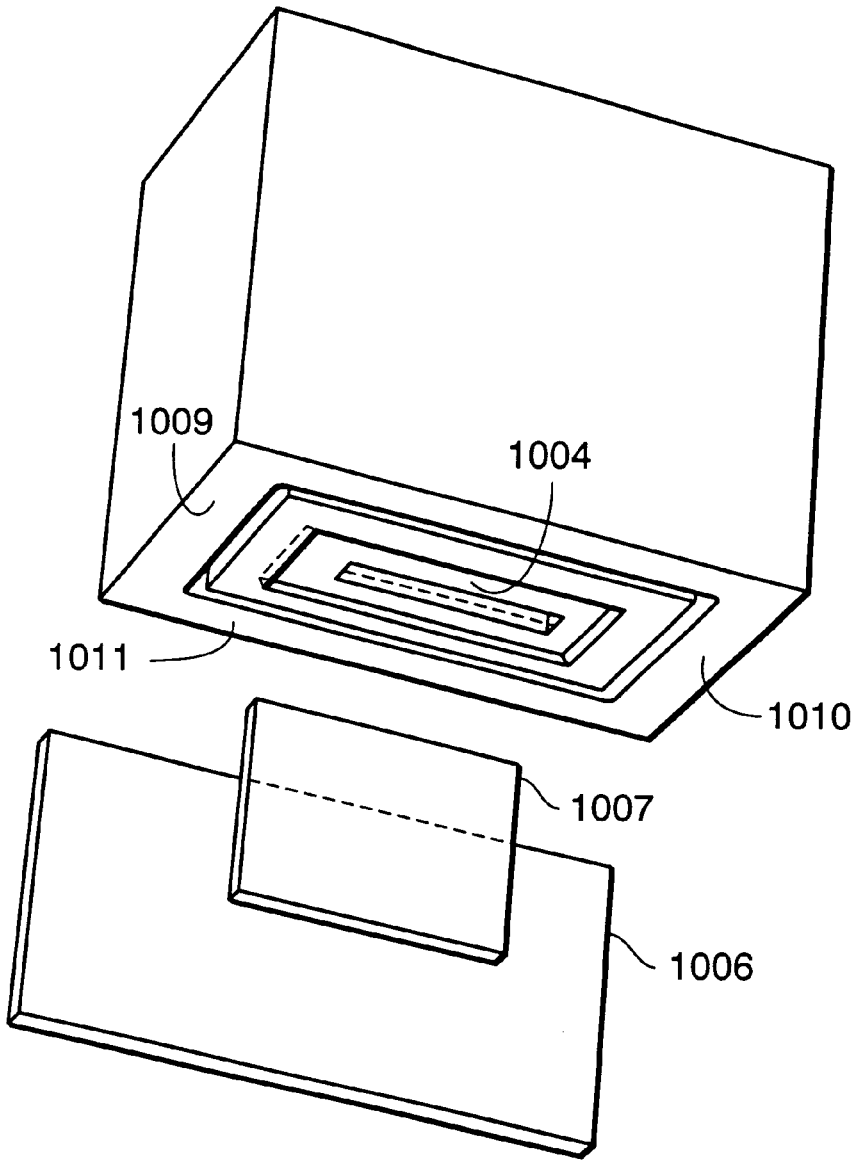
FIG. 2 is a view illustrating a conventional system for wiping an engraved ink jet print head.
Figure 4:
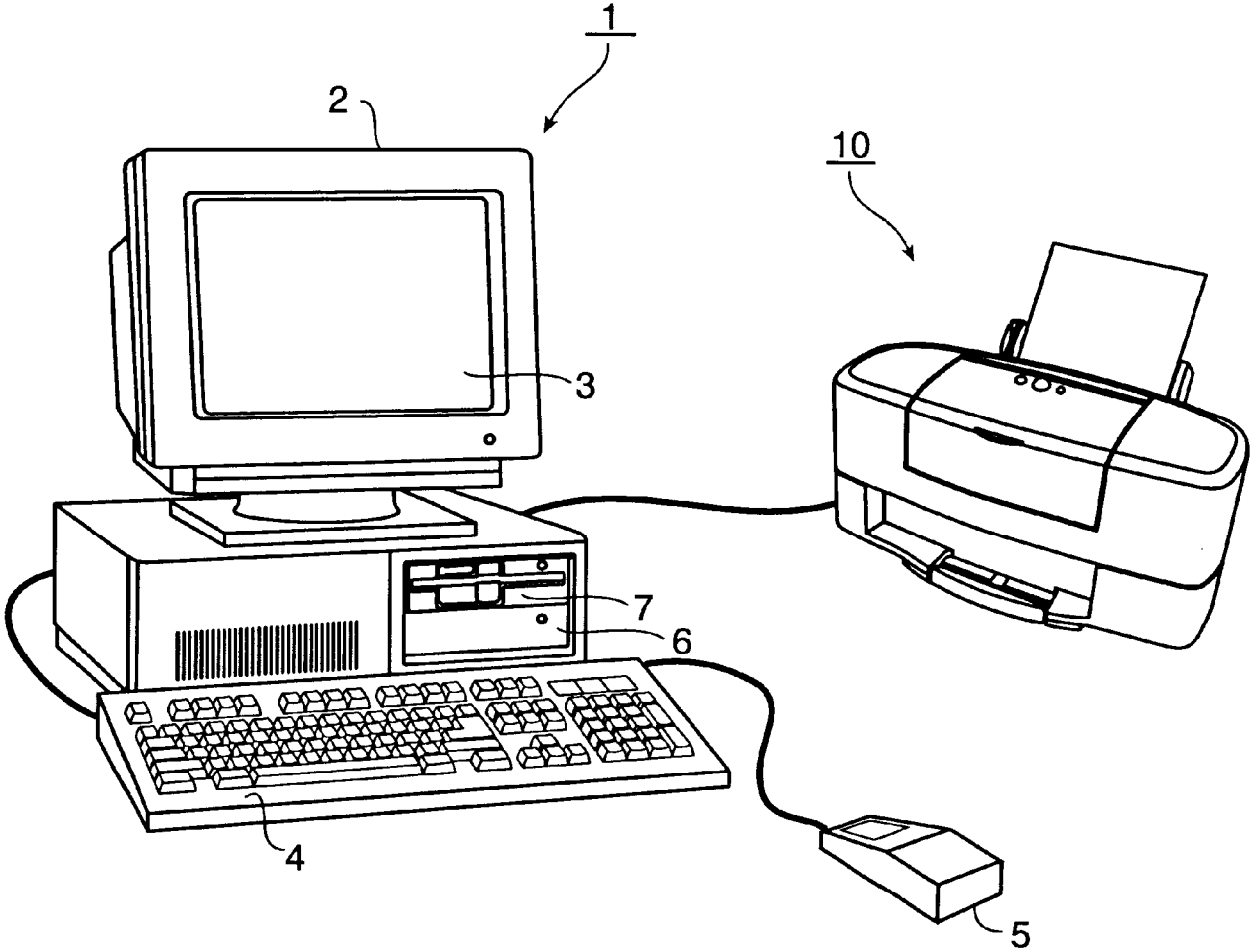
FIG. 4 is a perspective view of computing equipment embodying the present invention.

FIG. 4 is a view showing the outward appearance of computing equipment used in connection with the invention described herein. Computing equipment 1 includes host processor 2. Host processor 2 is preferably an IBM®-compatible personal computer executing a windowing environment, such as Microsoft® Windows95®. Of course, host processor 2 may be a Macintosh®-compatible system or other system executing another operating system.

Provided with computing equipment 1 are display screen 3, such as a color monitor or the like, keyboard 4 for entering text data and user commands, and pointing device 5. Pointing device 5 preferably is a mouse for pointing to and for manipulating objects displayed on display screen 3.

Also provided with computing equipment 1 are computer-readable memory media, such as fixed computer disk 6 and floppy disks loaded in floppy disk interface 7. In this regard, floppy disk interface 7 provides a means whereby computing equipment 1 can access information, such as data files, application programs, etc., stored on floppy disks. A similar CD-ROM interface (not shown) may be provided with computing equipment 1 through which computing equipment 1 can access data and computer-executable process steps stored on a CD-ROM.

Disk 6 stores, among other things, computer-executable process steps of application programs by which host processor 2 generates files, manipulates and stores those files on disk 5, presents data in those files to an operator via display 3, and prints data of those files via ink jet printer 10. Disk 5 also stores an operating system which controls operations of each element of computing equipment 1, as well as device drivers, at least one of which is a printer driver which provides a software interface to firmware in printer 10.

In a preferred embodiment of the invention, printer 10 is multi-head serial ink jet printer. Accordingly, although the invention described herein is not limited to use with such an ink jet printer, the invention will be described in the context of such a printer.

Figure 5:
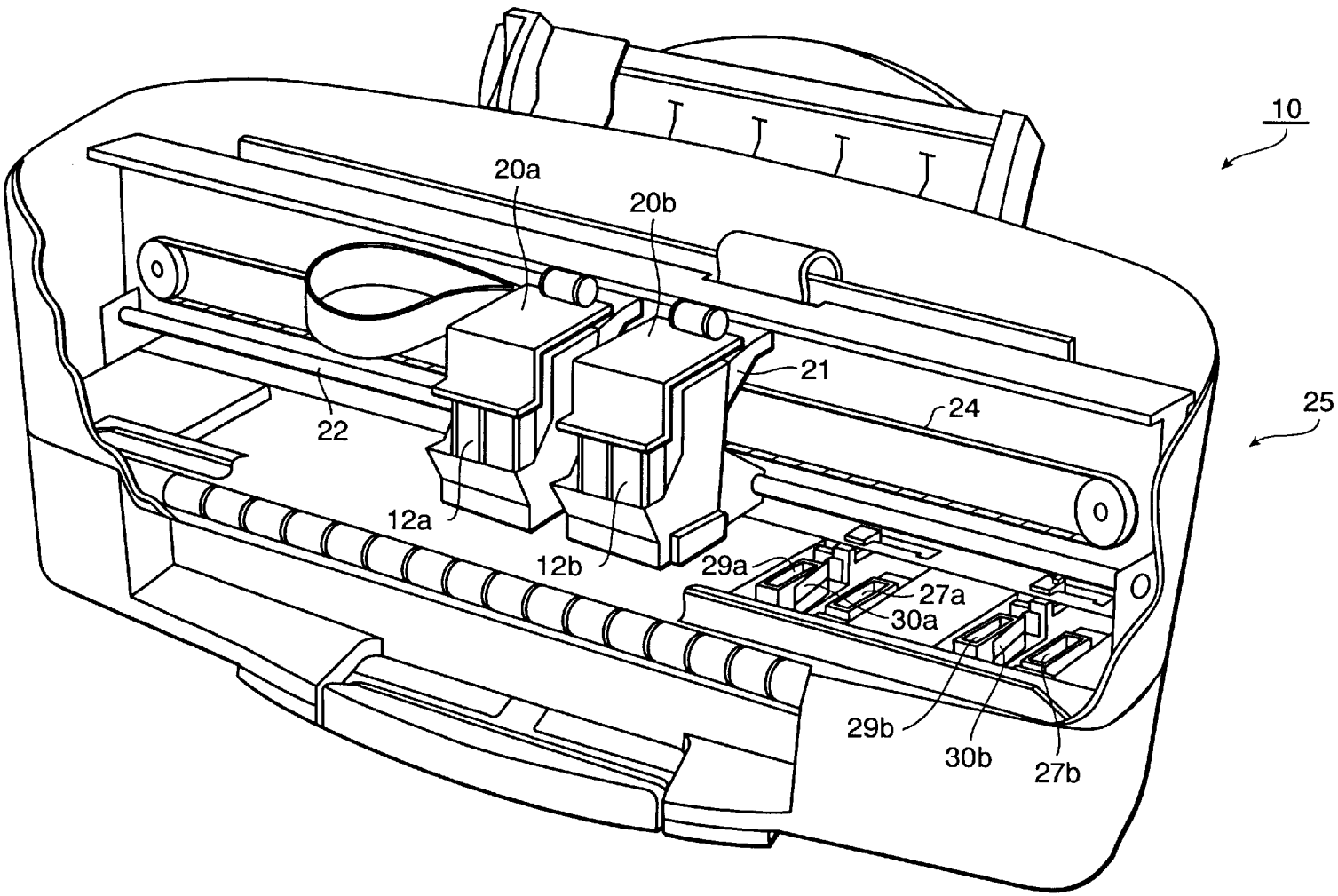
FIG. 5 is a front, cut-away perspective view of the printer shown in FIG. 4.

FIG. 5 is a front, cut-away perspective view of printer 10. As shown in FIG. 5, printer 10 is a dual ink jet cartridge printer which prints images using two ink jet print heads, one print head per cartridge. Each print head contains multiple ink jet nozzles which are used to print data upon a recording medium.

Figure 6:
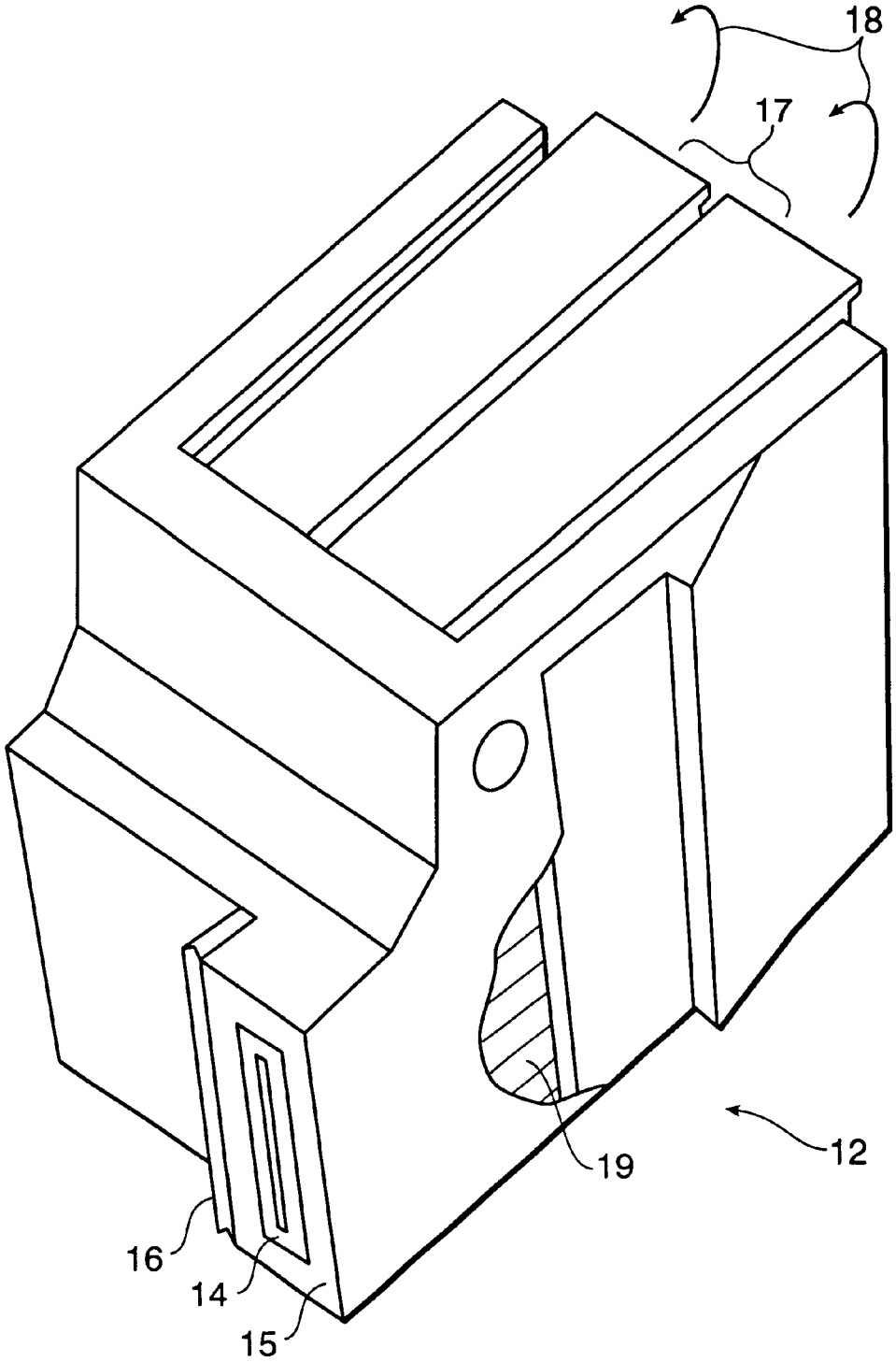
FIG. 6 is a perspective view of a print head for use in conjunction with the present invention.

FIG. 6 is a representative view of an ink jet cartridge for use in conjunction with the present invention. Ink jet cartridge 12 contains ink jet nozzles 14, which are arranged linearly along the surface of print head 15. As discussed briefly above, the openings of nozzles 14 may be flush with the surface of print head 15, or, in the case of an engraved ink jet print head, flush with the surface of a small groove within print head 15. Adjacent to print head 15 is wiper cleaner 16, the uppermost surface of which is substantially flush with print head 15, which is used to clean a wiping element. Operation of wiper cleaner 16 will be described more fully below.

Ink jet cartridge also includes ink tanks 17 which contain ink for ejecting through nozzles 14 onto a recording medium. For color printing, one of ink tanks 17 contains cyan, magenta, and yellow ink, while the other ink tank contains black ink. Alternatively, ink tanks 17 may be a single ink tank containing ink of a single color, or one ink tank containing cyan, magenta, yellow and black ink and another containing cyan, magenta and yellow "photo" ink for use in photo-quality printing. Ink tanks 17 are removable by applying pressure in the direction of arrows 18. Ink jet cartridge 12 also includes connection 19 which interfaces to control signals for controlling ejection of ink through nozzles 14.

Returning to FIG. 5, cartridges 12*a* and 12*b* each contain a print head and are respectively held in cartridge receptacles 20*a* and 20*b*. Receptacles 20*a* and 20*b* are in turn parts of carriage 21. Carriage 21 is pulled laterally along bar 22 by belt 24, which is driven by a carriage motor (not shown). As carriage 21 moves, ink jet nozzles 14*a* and 14*b* of print heads 15*a* and 15*b* are instructed to eject ink droplets toward a recording medium fed past the ink jet nozzles in accordance with an image to be printed. Carriage 21 can move from left to right as well as from right to left, thereby providing dual-directional printing as needed.

As described above, ink jet nozzles 14*a* and 14*b* of ink jet cartridges 12*a* and 12*b* tend to become obstructed with ink over time. Accordingly, the nozzles require intermittent cleaning, such as by a wiping system according to the present invention.

In this regard, and in response to command from host processor 2 or from commands from internal printer control logic, carriage 21 can be moved toward home side 25 of printer 10, to a home position. Carriage 21 is moved to the home position, for example, when printer 10 has finished a print job, when printer 10 is idle, when printer 10 is turned off, when paper is being ejected from printer 10, or when print heads 15*a* and 15*b* of cartridges 12*a* and 12*b* need to be cleaned.

In order to clean print heads 15*a* and 15*b*, disposed at the home position are ink suction devices 27*a* and 27*b*, ink expulsion receptacles 29*a* and 29*b*, and wiper blades 30*a* and 30*b*.

Ink suction devices 27*a* and 27*b* preferably comprise a rotary pump and print head connection caps. The print head connection caps connect to print heads 15*a* and 15*b* of cartridges 12*a* and 12*b* during print head cleaning and at other times, such as when printer 10 is powered off, so as to protect print heads 15*a* and 15*b*.

Ink expulsion receptacles 29*a* and 29*b* preferably receive ink expelled from print heads 15*a* and 15*b* during a purging procedure intended to clean excess ink from inside ink jet nozzles 14*a* and 14*b*.

Operation of wiper blades 30*a* and 30*b* is described in detail below.

Figure 7:
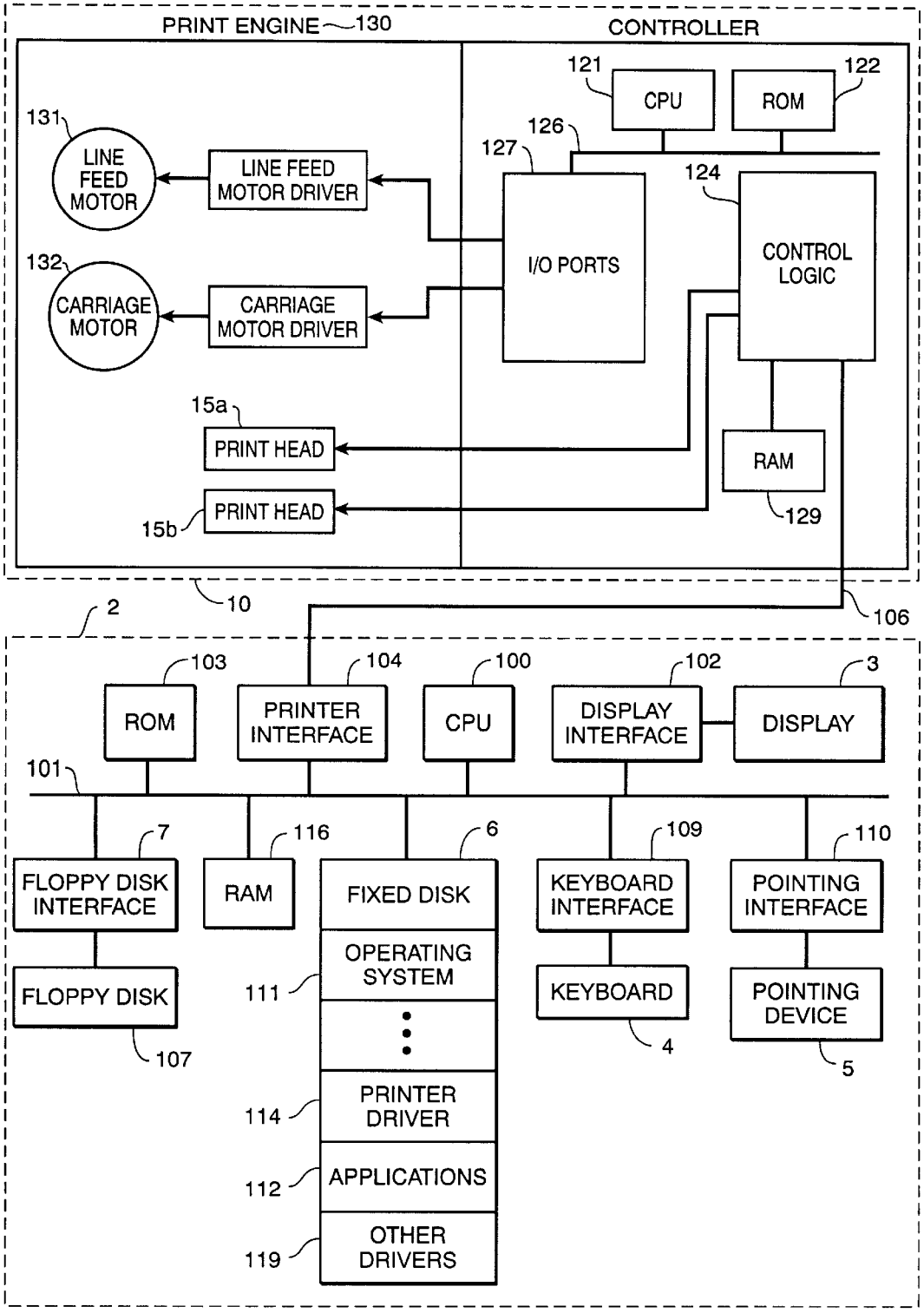
FIG. 7 is a block diagram showing a hardware configuration of a host processor interfaced to a printer.

FIG. 7 is a block diagram showing the internal functional structure of host processor 2 and printer 10. As shown, host processor 2 includes a central processing unit 100 such as a programmable microprocessor interface to computer bus 101. Also interfaced to computer bus 101 are display interface 102 for interfacing to display 3, printer interface 104 for interfacing to printer 10 through bi-directional communication line 106, floppy disk interface 7 for interfacing to floppy disk 107, keyboard interface 109 for interfacing to keyboard 4, and pointing device interface 110 for interfacing to pointing device 5. Disk 6 includes computer-executable process steps to execute operating system 11, computer-executable process steps to execute applications 112, and computer-executable process steps embodying printer driver 114.

Random Access Memory (hereinafter "RAM") 116 interfaces to computer bus 101 to provide CPU 100 with access to data storage. In particular, when executing stored computer-executable process steps such as those associated with applications 112, CPU 100 loads those process steps from disk 6 (or other storage media such as media accessed via a network or floppy disk interface 7) into RAM 116 and executes those computer-executable process steps out of RAM 116. RAM 116 also provides for a print data buffer used by printer driver 114. It should be recognized that standard disk swapping techniques available under a windowing operating system allows segments of memory, including the aforementioned print data buffer, to be swapped on and off of disk 6.

In operation with printer 10, printer driver 114 controls printer interface 104 to transfer print data to printer 10 via line 106 and to exchange control signals between host processor 2 and printer 10, also via line 106.

Printer 10 includes CPU 121 such as an 8-bit or a 16-bit microprocessor, ROM 122, control logic 124, and I/O ports unit 121 connected to bus 126. Control logic 124 includes controllers for line feed motor 131, for carriage motor 132, for print image buffer storage in RAM 129, and for heat pulse generation. Control logic 124 also provides control signals in print data for print heads 15*a* and 15*b* of print engine 130 and is coupled to printer interface 104 of host processor 2 via communication line 106 for exchange of control signals and to receive print data and print data addresses.

I/O ports unit 127 is coupled to print engine 130. In print engine 130, print heads 15*a* and 15*b* perform recording on a recording medium by scanning across the recording medium while ejecting ink droplets according to print data from a print buffer in RAM 129. In this regard, RAM 129 stores print data in a print buffer defined by printer driver 114 and other information for printer operation. In addition, ROM 122 stores font data, computer-executable process used to control printer 10, and other invariant data for printer operation.

Although FIG. 7 shows individual components of printer 10 as separate and distinct from one another, it is preferable that some of the components be combined. For example, control logic 124 may be combined with I/O ports unit 127 in an ASIC to simplify interconnections within printer 10.

First Embodiment

As described in the Description Of The Related Art, conventional wiping systems allow ink to harden on wiping elements, thereby degrading effectiveness of subsequent wiping. In accordance with a first embodiment of the present invention, ink is wiped from a wiping element such that the effectiveness of subsequent wiping does not degrade to the extent experienced using conventional wiping systems.

Figure 8:
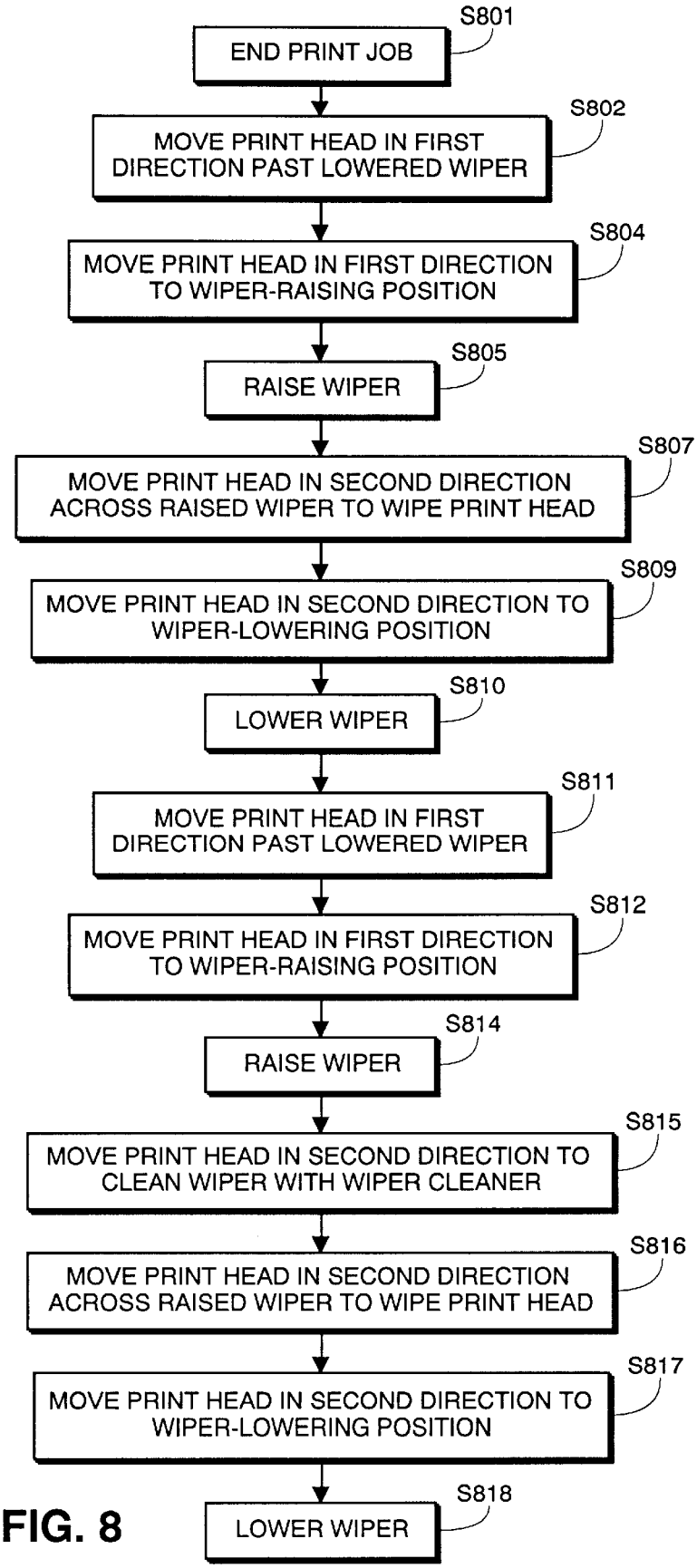
FIG. 8 is a flowchart of process steps to perform a wiping sequence according to the present invention.

In this regard, FIG. 8 is a flowchart of process steps in accordance with the first embodiment of the present invention. Preferably, the process steps of the FIG. 8 flowchart are embodied in computer-executable process steps stored on a computer-readable medium and executed by CPU 100 and/or CPU 121.

Briefly, the FIG. 8 process steps include steps to move a print head in a first direction past a lowered wiper, to move the print head in the first direction to a wiper-raising position, to raise the wiper, to move the print head in a second direction, opposite to the first direction, so as to wipe the print head using the raised wiper, to move the print head in the second direction to a wiper-lowering position, and to lower the wiper. The flowchart also includes steps to move the print head in the first direction past the lowered wiper, to move the print head in the first direction to a wiper-raising position, to raise the wiper, to move the print head in the second direction so as to clean the raised wiper with a wiper cleaner and so as to wipe the print head with the raised wiper, to move the print head in the second direction to the wiper-lowering position, and to lower the wiper.

More specifically, flow begins at step S801, at which point a print job has ended. Alternatively, step S801 may represent any other event which triggers a wiping operation, such as, but not limited to, an ejected droplet counter exceeding a threshold value, printer power-off, or the like. Flow proceeds to step S802, at which a print head is moved in a first direction past a wiping element, which is in a lowered position. FIG. 9*a* illustrates a situation according to step S802, in which print head 15 is moving past lowered wiper 30.

In this regard, the sequence shown in FIG. 9*a* through FIG. 9*d*, as well as each of the other wiping sequences described below, concerns ink jet cartridge 12*b* and corresponding print head 15*b*. However, the concepts described are equally applicable to ink jet cartridge 12*a* and print head 15*a*. Accordingly, the notations "a" and "b" are omitted from the explanations thereof.

Thus, FIG. 9*a* shows carriage receptacle 20 containing ink jet cartridge 12 moving toward home side 25 of printer 10. FIG. 9*a* also shows wiper blade 30 in a lowered position. Next, in step S804, print head 15 is moved to wiper-raising position I. Consequently, wiper blade 30 is raised in step S805.

Therefore, as shown in FIG. 9*b*, upon reaching wiper-raising position I, wiper blade 30 is raised. Any electrical, mechanical, or other type of control may be used to effect wiper raising upon reaching position I. A suitable arrangement is disclosed in U.S. patent application Ser. No. 09/019,912, filed Feb. 5, 1998 and entitled "Head Wiping Mechanism For Ink Jet Printer, the disclosure of which is herein incorporated by reference as if set forth in full.

In step S807, print head 15 is moved in a second direction opposite to the first direction across raised wiper blade 30 so as to wipe print head 15 with wiper blade 30.

In order to facilitate understanding regarding the operation of wiper blade 30, FIG. 10*a* shows a face-on view of wiper blade 30. Wiper blade 30 is fixed within wiper blade holder 31, which is in turn attached to a structure for raising and lowering wiper blade 30 while maintaining a substantially-fixed horizontal position of wiper holder 31, such as that described in aforementioned U.S. patent application Ser. No. 09/019,912.

Wiper blade 30 is preferably made of flexible material suitable for giving way to the passage of ink jet cartridge 12 while in a raised position, while still applying enough pressure upon print head 15 during such passage so as to adequately wipe ink from print head 15. Preferably, wiper blade 30 possesses these qualities in both a forward and backward direction, as indicated by arrows 32 of FIG. 10*b*.

FIG. 11*a* to FIG. 11*c* show step S807 in detail. In this regard, FIG. 11*a* shows print head 15, wiper cleaner 16, and wiper blade 30. Also shown in FIG. 11*a* is excess ink 35, which is located mainly along nozzles 14 and also at other regions on the surface of print head 15. As shown in FIG. 11*b*, motion of print head 15 in the second direction causes wiper blade 30 to contact print head 15 and to flex toward the second direction so as to allow print head 15 to pass. However, the resiliency of wiper blade 30 creates a force against print head 15. As a result, once print head 15 has passed, excess ink 35 is wiped from print head 15 and deposited upon wiper blade 30, as shown in FIG. 11*c*.

Figure 9C:
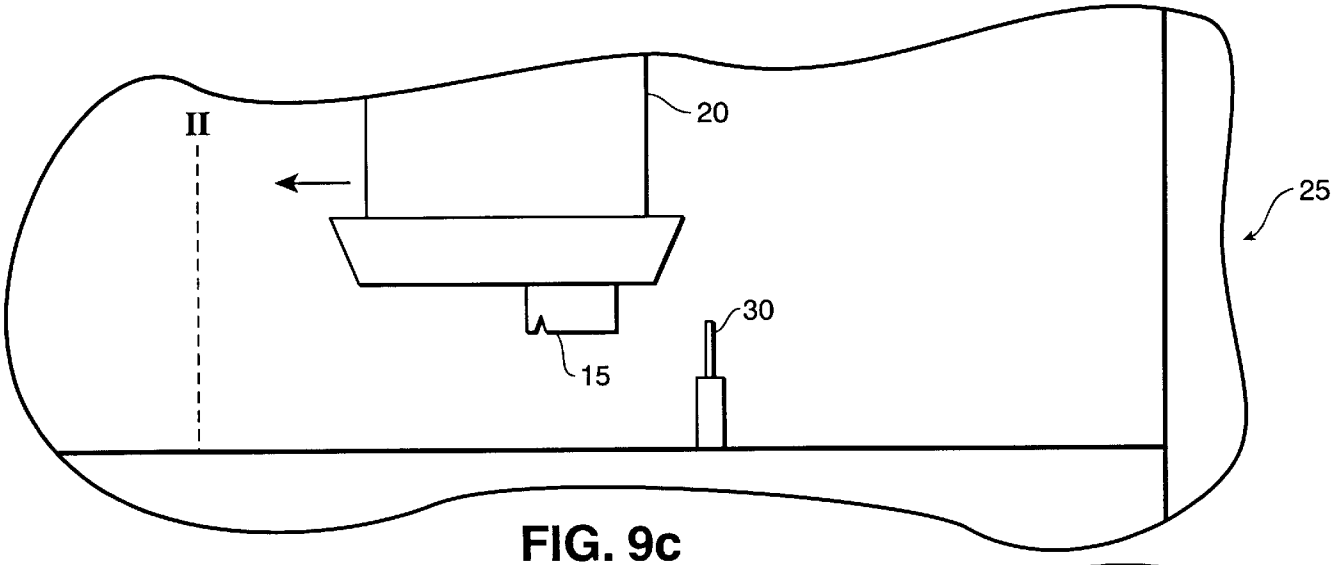
Figure 9D:
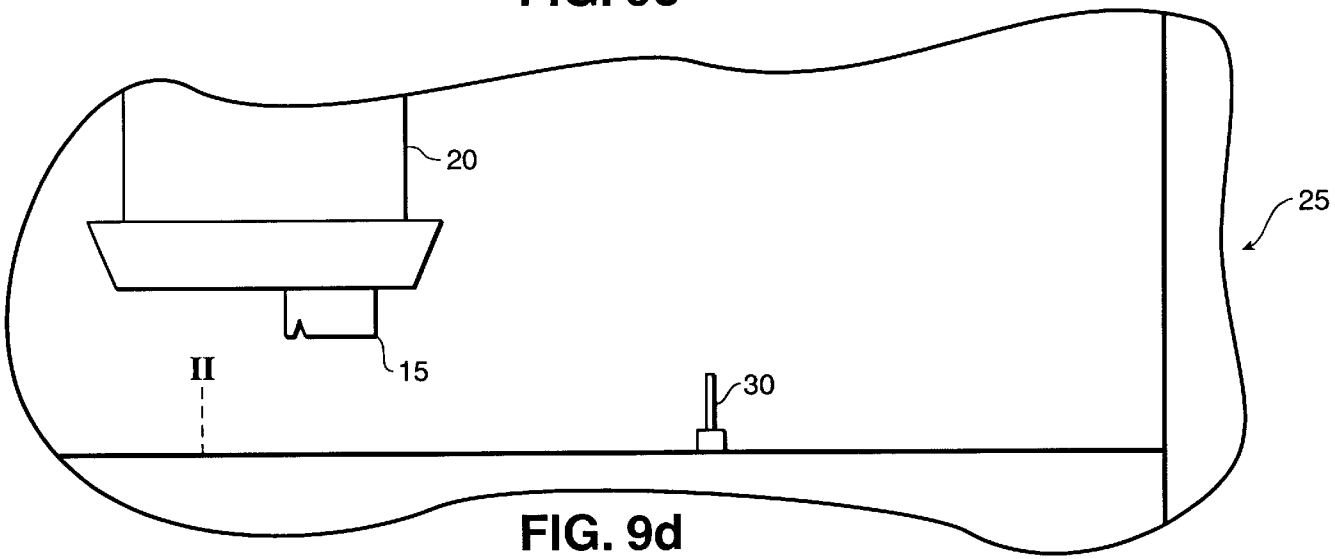

Returning to the FIG. 8 process steps, print head 15 continues to move, in step S809, in the second direction, as shown in FIG. 9*c*, to a wiper-lowering position, denoted by II of FIG. 9*d*. Accordingly, and as shown in FIG. 9*d*, wiper 30 is lowered in step S810.

Figure 11D:
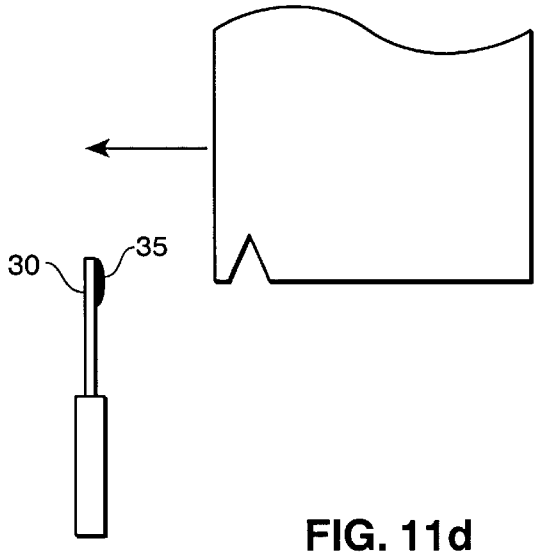

Next, in steps S811, S812 and S814, flow proceeds as described above with respect to steps S802, S804 and S805 respectively. However, as shown in FIG. 11*d*, wiper blade 30 has deposited thereon excess ink 35 during steps S811, S812 and S814. In this regard, FIG. 11*d* is a detailed view showing excess ink 35 upon wiper blade 30 after execution of step S814.

Figure 11E:
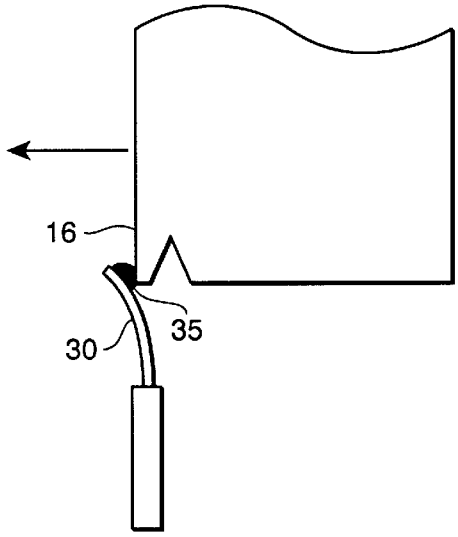
Figure 11F:
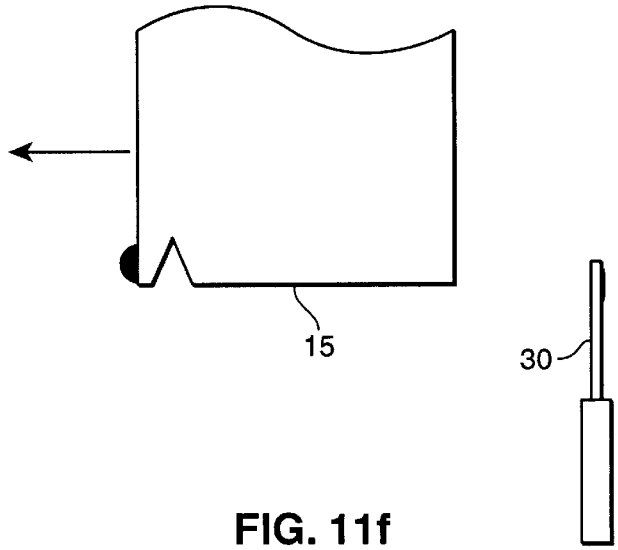

Flow proceeds from step S814 to S815, at which point print head 15 is moved in the second direction so as to drag wiper cleaner 16 across the surface of wiper blade 30. Step S815 is illustrated in FIG. 11*e*, which shows wiper cleaner 16 removing excess ink 35 from wiper blade 30. Next, in step S816, wiper blade 30 again wipes print head 15 as described above with respect to step S807. However, since no printing has occurred between steps S807 and S816, the amount of ink removed from print head 15 and deposited on wiper blade 30 during step S816 is much less than that wiped and deposited in step S807. FIG. 11*f* shows wiper cleaner 16, print head 15, and wiper blade 30 after execution of step S816.

Flow then proceeds from step S816 to steps S817 and S818 as described above with respect to steps S809 and S810.

Figure 12:
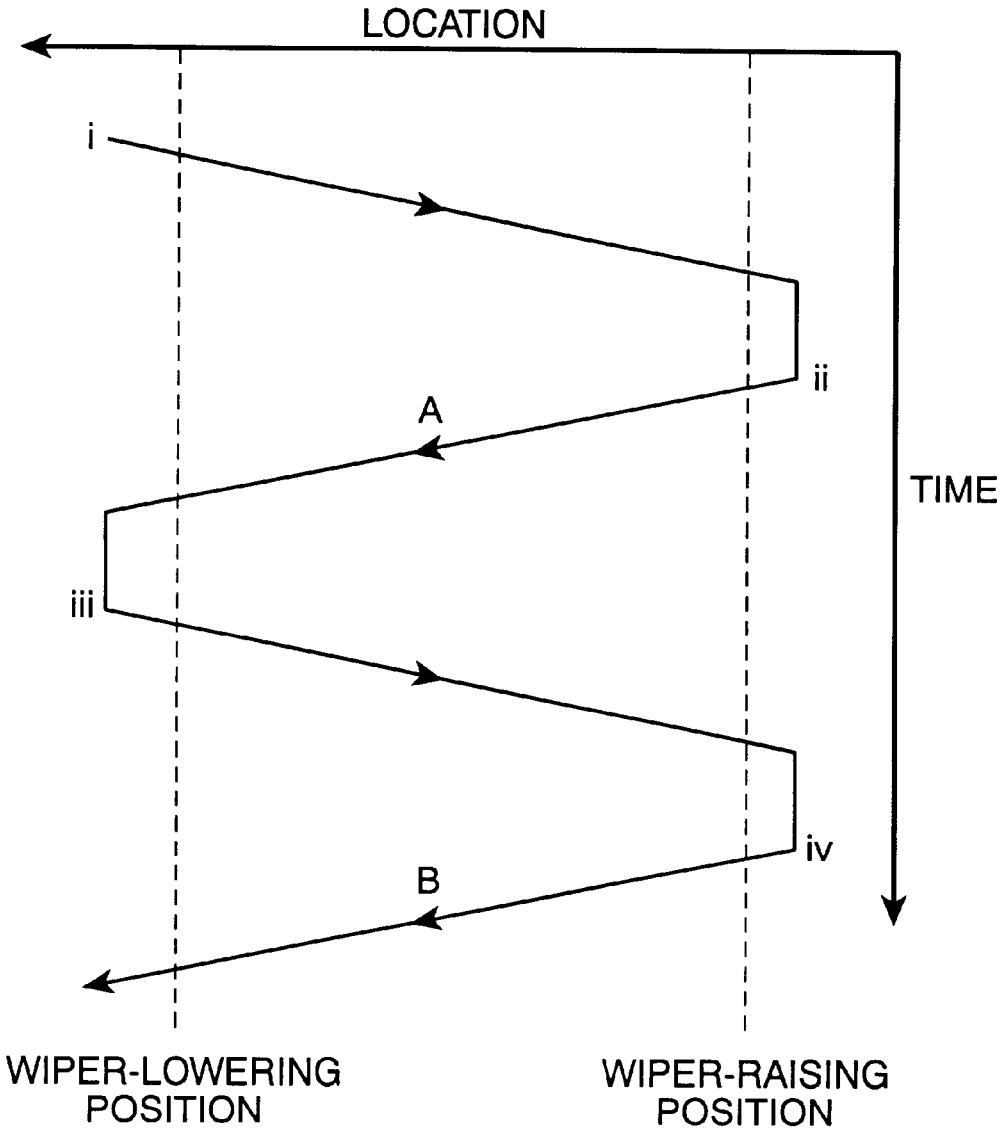
FIG. 12 is a diagram illustrating relative positions of an ink jet print head over time during a wiping sequence according to the present invention.

FIG. 12 is a diagram generally illustrating the FIG. 8 process steps. In this regard, path i illustrates the route taken by print head 15 from steps S801 to S805, and path ii illustrates the path taken by print head 15 from steps S807 to S810, with the letter A being indicative of a location at which print head 15 is wiped by wiper 30. Path iii is travelled by print head 15 from steps S811 to S814, and path iv is travelled by print head 15 from steps S815 to S818, wherein steps S815 and S816 are performed at location B.

The present embodiment is intended for use with an ink jet print head having nozzle openings flush with the surface of the ink jet print head as well as with an engraved ink jet print head.

It should be noted that the FIG. 8 process steps may also be used in a case where a home position of printer 10 is located on a side of printer 10 opposite to home side 25, in which case printer cleaner 16 should be located closer to home side 25 than print head 15 and in which case the first and second directions described above are reversed.

It should also be noted that the present invention may be used in conjunction with any suitable wiping element and wiping element cleaner, and that the wiper blade and wiper cleaner described above are merely preferred embodiments of the present invention.

By virtue of the foregoing embodiment, excess ink collects on wiper cleaner 16 rather than on wiper blade 30. As a result, subsequent wiping does not degrade to the extent noted above with respect to conventional wiping systems.

Also by virtue of the foregoing, wiper cleaner 16 is not positioned on a same side of print head 15 as connection 19 for interfacing to control signals. Advantageously, avoiding such an arrangement reduces the cost of disposable ink jet cartridge 12 and the complexity of a system according to the present invention.

In this regard, it should be noted that wiper cleaner 16 is preferably an integral part of ink jet cartridge 12, which is periodically replaced. Accordingly, the excess ink which builds up on wiper cleaner 16 is periodically removed from printer 10 upon replacement of ink jet cartridge 12. In contrast, the useful life of wiper blade 30 commonly exceeds that of several ink jet cartridges. Accordingly, conventional systems allow ink to accumulate on wiper blade 30 longer than ink is allowed to accumulate on a wiper cleaner used according to the present invention.

Second Embodiment

The above-described first embodiment is useful in wiping ink from an ink jet head after a print job is performed. However, after ink nozzles are purged, which consists of firing several droplets of ink through the nozzles at high velocity in order to clear the nozzles, greater amounts of excess ink are deposited on the surface of the print head than that deposited on the print head after a print job. The present invention according to the second embodiment addresses the foregoing by performing an intermediate backward wipe between the two wipes described with respect to the first embodiment.

Figure 13:
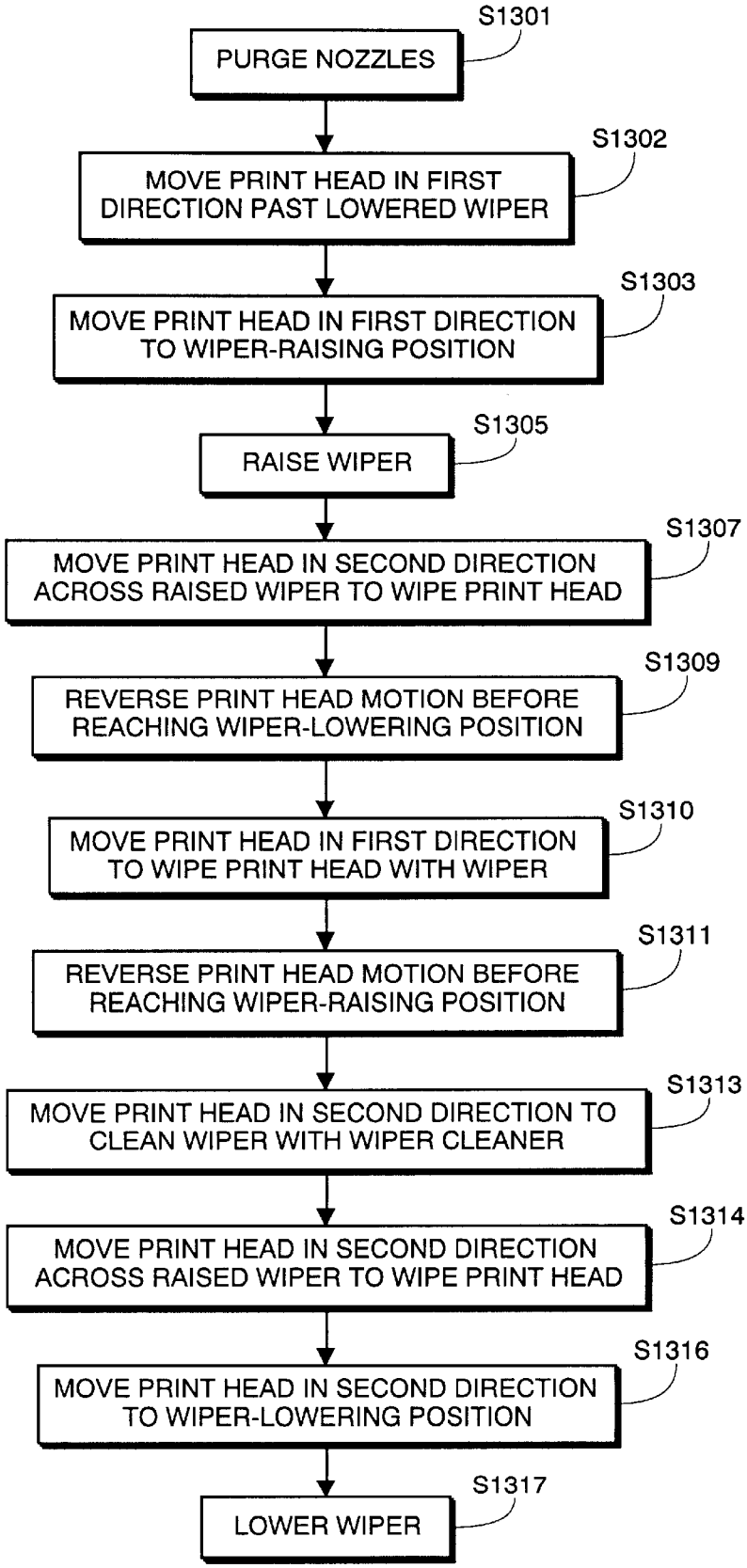
FIG. 13 is a flowchart of process steps to perform a wiping sequence according to the present invention.

In this regard, FIG. 13 is a flowchart describing process steps in accordance with the second embodiment of the present invention. Preferably, the FIG. 13 process steps are embodied in computer-executable process steps stored on a computer-readable medium and executed by CPU 100 and/or CPU 121.

Briefly, the process steps of FIG. 13 include steps to move a print head in a first direction past a lowered wiper, to move the print head in the first direction to a wiper-raising position, to raise the wiper, and to move the print head in a second direction across the raised wiper so as to wipe the print head. The steps also include steps to reverse print head motion before reaching a wiper-lowering position, to move the print head in the first direction so as to wipe the print head with the raised wiper, to reverse print head motion before reaching the wiper-raising position, to move the print head in the second direction so as to clean the wiper with a wiper cleaner and so as to wipe the print head, to move the print head in the second direction to the wiper-lowering position, and to lower the wiper.

In more detail, the FIG. 13 process steps begin at step S1301, at which ink jet nozzles 14 of print head 15 are purged, resulting in a significant amount of excess ink being located on the nozzle surface of print head 15. Alternatively, step S1301 may be any other event which requires wiping according to the second embodiment of the invention, such as a detection of excess ink on the print head or the like.

Flow then proceeds to step S1302. In this regard, steps S1302, S1303, S1305 and S1307 proceed similarly to steps S802, S804, S805 and S807 of FIG. 8 and descriptions thereof are omitted for the sake of brevity.

Accordingly, after execution of step S1307, print head 15 has been wiped by wiper blade 30. However, due to the amount of excess ink located on print head 15, ink likely remains on print head 15. FIG. 14*a* illustrates print head 15 and wiper blade 30 after execution of step S1307. As shown, residual ink 40 remains on print head 15 even though wiper blade 30 has collected a significant amount of excess ink, shown as excess ink 42.

In more detail, FIG. 14*b* shows a closeup view of nozzles 14 of print head 15 after execution of step S1307. As shown, much of residual ink 40 has been pushed to the right side of nozzles 14 and hangs thereon.

Returning to the process steps of FIG. 13, flow proceeds from step S1307 to step S1309, wherein motion of print head 15 is reversed prior to reaching above-described wiper-lowering position II. FIG. 15*a* shows the physical relation of print head 15 and wiper 30, as well as the motion of print head 15, upon execution of step S1309. Next, in step S1310, print head 15 is moved in the second direction so as to wipe print head 15 with wiper 30. As shown in FIG. 15*b* and FIG. 15*c*, residual ink 40 is wiped from print head 15 using a side of wiper blade 30 opposite to the side which wiped print head 15 in step S1307. Accordingly, a portion of residual ink 40, referred to as reverse-wiped ink 45, is deposited on wiper blade 30. It should be noted that a significant portion of residual ink 40 is pushed into nozzles 14 during step S1310.

Next, in step S1311, the motion of print head 15 is reversed before reaching wiper-raising position I. In this regard, steps S1313, S1314, S1316 and S1317 proceed according to steps S815, S816, S817 and S818, respectively, so as to clean excess ink 42 from wiper blade 30 with wiper cleaner 16, to wipe print head 15 with wiper blade 30, to move print head 15 to wiper-lowering position II, and to lower wiper 30.

It should be understood that reverse-wiped ink 45 remains on wiper blade 30 throughout step S1313 to step S1317 since reverse-wiped ink 45 does not come into contact with wiper cleaner 16 or print head 15 during those steps. It should also be understood that, during steps S1309 and S1310 of a next wiping, reverse-wiped ink 45 is scraped off wiper blade 30 and deposited on print head 15 by virtue of contact between wiper blade 30 and corner 47, shown in FIG. 15*c*.

Figure 16:
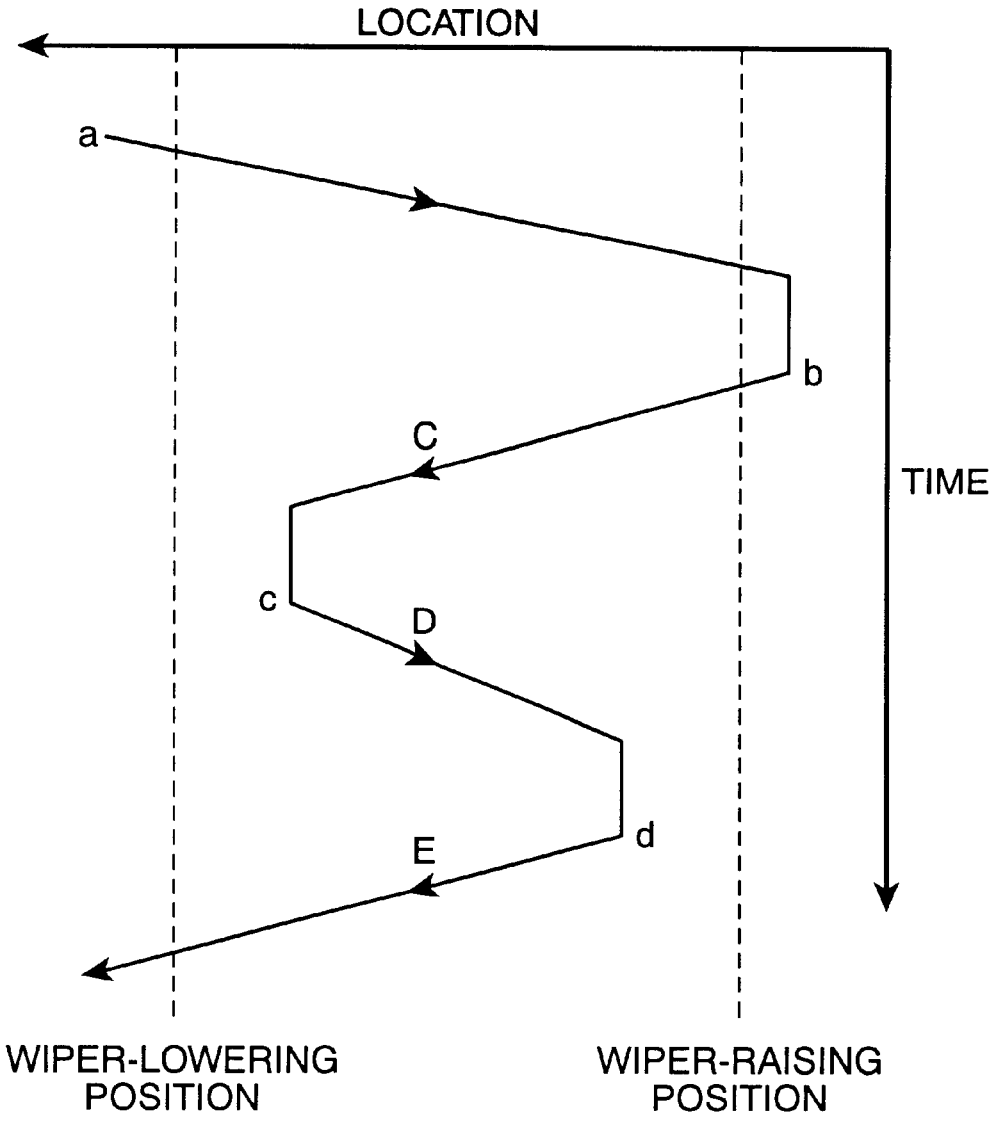
FIG. 16 is a diagram illustrating relative positions of an ink jet print head over time during a wiping sequence according to the present invention.

FIG. 16 illustrates the path of print head 15 during the FIG. 13 process steps. In this regard, path a is travelled by print head 15 during steps S1302 to S1305, and path b is travelled during steps S1307 to S1309, with wiping occurring at location C. Moreover, path c is travelled by print head 15 during steps S1310 and S1311, with reverse wiping occurring approximately at location D, and path d is travelled by print head 15 during steps S1313 to S1317, with wiping occurring at location E.

It should be noted that step S1311 may be omitted from the FIG. 13 process steps when used in a system in which motion of a print head to a wiper-raising position has no effect in a case that a wiper is already raised. However, even in such systems, it is preferable to include step S1311 in order to increase the speed of the wiping sequence.

Moreover, since, as described with respect to step S1310, the foregoing process steps cause excess ink to be pushed inside nozzles of a subject print head, it is preferable to eject several ink droplets from each of the nozzles prior to printing so as to avoid printing too great a volume of ink once printing resumes.

By virtue of the foregoing, the present invention effectively cleans excess ink from a print head. The foregoing steps also provide effective cleaning of a wiping element with a wiping element cleaner by cleaning the wiping element before wiped ink is able to adhere strongly to the wiping element. Accordingly, ink buildup on both the print head and the wiping element is reduced and subsequent wiping is thereby improved.

Third Embodiment

The foregoing embodiments provide more effective wiping than experienced with conventional wiping systems. In this regard, a third embodiment of the present invention utilizes various combinations of the above-described embodiments in order to provide an advantageous combination of wiping speed and wiping effectiveness during printer operation.

Figure 17:
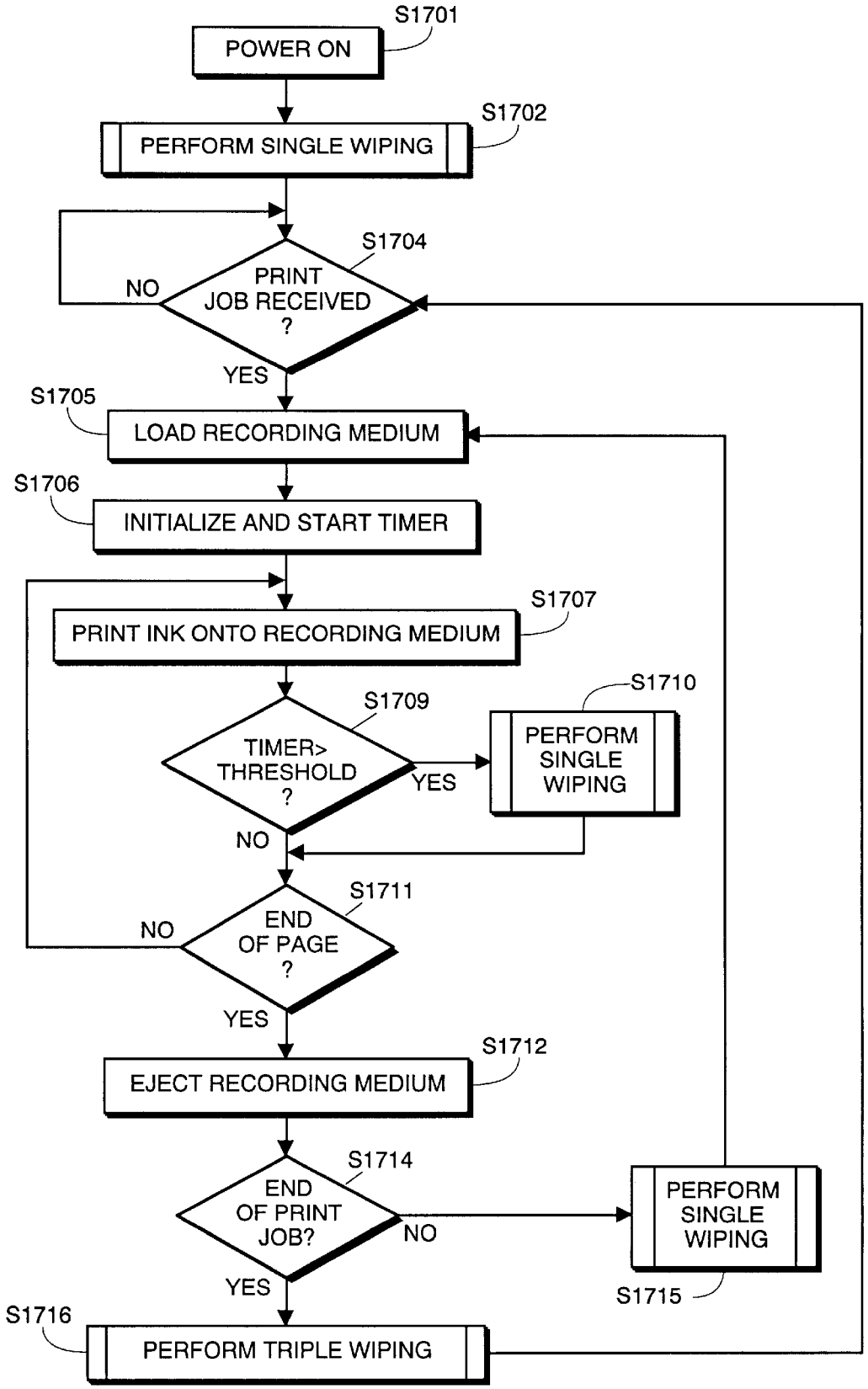
FIG. 17 is a flowchart of process steps to control selection of wiping processes during printing according to the present invention.

A wiping sequence according to the third embodiment of the present invention is described in the FIG. 17 flowchart. Preferably, the FIG. 17 process steps are embodied in computer-executable process steps stored on a computer-readable medium and executed by CPU 100 and/or CPU 121.

Briefly, the FIG. 17 process steps include printer power-on, single wiping of a print head, waiting for a print job, loading a recording medium upon reception of a print job, and initializing and starting a timer. The process steps also include printing ink upon the recording medium, performing single wiping in a case that the timer exceeds a threshold, and determining an end of page condition. The recording medium is ejected due to an end of page condition, and, if a current print job requires further printing, single wiping is performed. If the print job has been completed, triple wiping is performed.

More specifically, flow begins at step S1701, in which printer 10 is powered on. Flow then proceeds to step S1702, wherein single wiping is performed. Single wiping according to step S1702 proceeds along the lines of steps S802 to S810 shown in the FIG. 8 flowchart and described above.

In step S1704, it is determined whether a print job has been received. If not, flow pauses at step S1704 until a print job is received. Once a print job is received, flow continues to step S1705, in which a recording medium is loaded into printer 10 in preparation for ejecting ink onto the recording medium using print heads 15*a* and 15*b*. Next, in step S1706, a timer is initialized and activated.

Ink is ejected onto the recording medium in step S1707. In step S1709, the timer is checked to determine whether it has reached a value greater than a threshold value. If so, single wiping, as performed in step S1702, is performed in S1710. Flow then proceeds to step S1711. If, in step S1709, it is determined that the timer has not reached a value greater than the threshold value, flow proceeds directly to step S1711.

In step S1711, it is determined whether printer 10 has encountered an end of page command. If not, flow returns to step S1707 and proceeds as described above. If an end of a page command has been encountered, flow proceeds to step S1712, wherein the recording medium is ejected from printer 10.

Next, in step S1714, it is determined whether an end of print job command has been received. If not, flow proceeds to step S1715, wherein single wiping is performed as in steps S1702 and S1710, and thereafter returns to step S1705. If an end of print job command has not been received, flow continues from step S1714 to S1716. In step S1716, wiping according to the above-described second embodiment of the invention is performed, referred to below as "triple wiping". Flow then returns to step S1714 to await a next print job.

By virtue of the foregoing process steps, fast wiping is performed before a print job commences, at specified intervals during the print job based on the threshold value used in step S1709, and after each page in a print job is printed. Moreover, a triple wiping procedure is performed after each print job terminates. As a result, printing proceeds quickly and print quality is maintained over the course of printer operation.

It should be noted that the FIG. 17 process steps may be altered in accordance with desired printing speed and wiping effectiveness. For example, instead of performing triple wiping in step S1716, wiping according to the above-described first embodiment, hereinafter called "double wiping", can be performed. Such an alteration in step S1716 is beneficial in cases where the surface of a subject print head is not greatly contaminated with ink. This situation can occur if the number of print jobs performed since a last triple wiping is less than a small predetermined number, if a number of droplets ejected since a last triple wiping is less than a small predetermined number, or if an elapsed time since a last triple wiping is less than a predetermined amount.

Moreover, double wiping may replace single wiping in any or all of steps S1702, S1710, and S1715. Such a replacement is especially appropriate in a case where an increase in wiping effectiveness is desired at a cost of printing speed.

Fourth Embodiment

The foregoing embodiments all benefit from the discovery that ink is more readily removed from a wiping element if the ink is not allowed to dry significantly. Applicants have also discovered that ink is also more readily removed from a surface if the surface ink is moistened using additional ink. Accordingly, the present embodiment addresses the above-described problems by wetting a surface of an ink jet print head before and during wiping. FIG. 18*a* to FIG. 18*d* each illustrate an aspect of the present embodiment, which is denoted "wet wiping".

FIG. 18*a* is a detailed view showing wiper blade 30 during contact with ink jet print head 15 at the beginning of a wet wiping sequence. As shown, nozzles 14 eject ink droplets onto wiper blade 30 as wiper blade 30 wipes print head 15. Ejection of the ink causes ink to adhere to wiper blade 30 on leading surface 50. Significantly, the ejected ink also deflects off of wiper blade 30 onto leading region 52 and trailing region 54 of print head 15.

FIG. 18*b* illustrates a preferred modification of the system shown in FIG. 18*a*. In FIG. 18*b*, nozzles 14 of ink jet print head 15 are disposed at an angle of 10 degrees from vertical in a direction toward leading region 52. Accordingly, the resulting angle of deflection of ink off of wiper blade 30 causes more ink to collect on leading region 52 than on trailing region 54.

The FIG. 18*b* modification is preferred because it is important to ensure that leading region 52 is sufficiently wet prior to wiping with wiper blade 30 in order to facilitate removal of ink from region 52. It is not as great of a concern to wet region 54 prior to beginning wiping of print head 15 because ink located on region 52 and on the openings of nozzles 14 is pushed onto region 54 during wiping, thereby sufficiently wetting region 54.

Of course, wet wiping according to the present embodiment can be used in conjunction with print heads having nozzles disposed substantially vertically, as shown in FIG. 18*a*. However, such a configuration would cause less ink to collect on region 52 and more ink to collect on region 54 than with print heads having the configuration shown in FIG. 18*b*. As a result, region 52 may not be sufficiently wet and wiping effectiveness would be less than that provided by the preferred system illustrated in FIG. 18*b*.

Figure 18C:
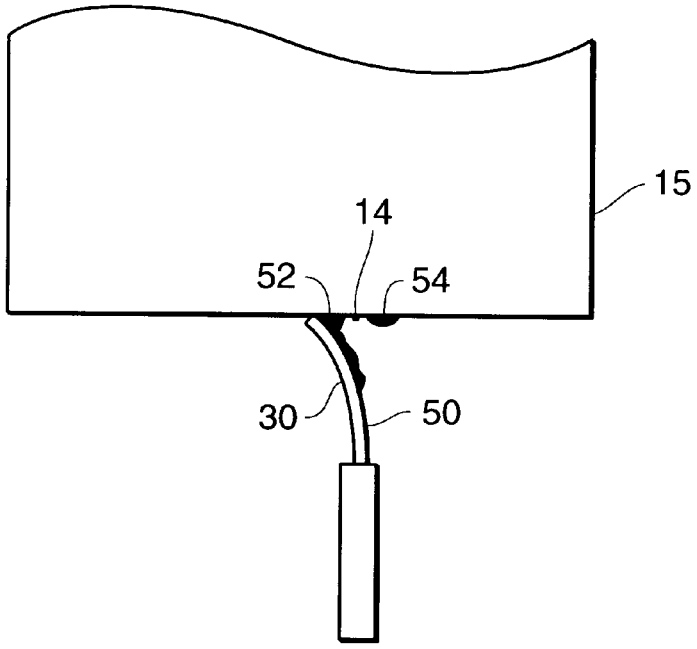

FIG. 18*c* illustrates wet wiping at a time after that represented in FIG. 18*a*. As shown in FIG. 18*c*, leading surface 50 of wiper blade 30 has accumulated more ink than shown in FIG. 18*a*, while regions 52 and 54 each have collected more ink. It should be noted that, according to the present embodiment, ink ejection ceases before the uppermost portion of wiper blade 30 reaches nozzles 14.

By virtue of the foregoing, regions 52 and 54 are wiped, and the wetness thereof improves wiping of ink which was deposited on print head 15 prior to wiping. Accordingly, wet wiping provides more effective wiping of ink from an ink jet print head than that provided by conventional systems. In this regard, FIG. 18*d* shows print head 15 and wiper blade 30 after completion of wet wiping according to the present embodiment.

Fifth Embodiment

Figure 18D:
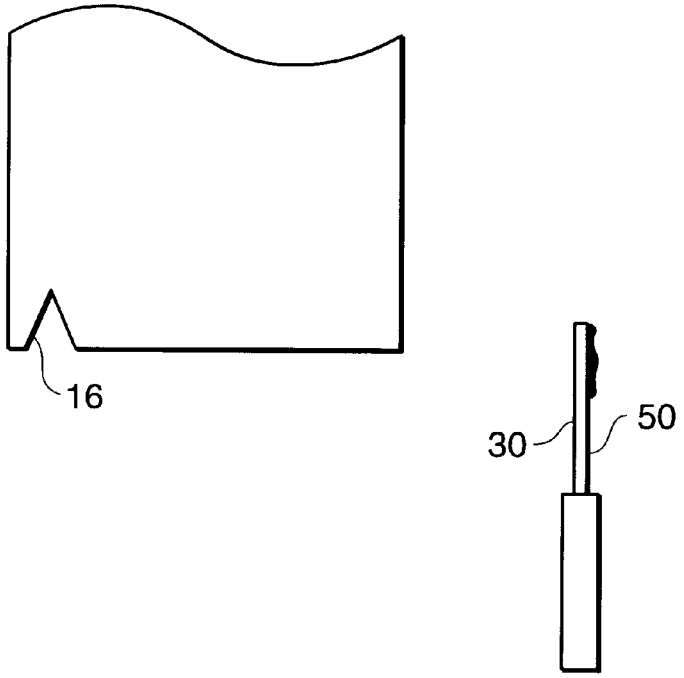

As shown in FIG. 18*d*, wiping according to the fourth embodiment concludes with a significant amount of ink deposited upon wiper blade 30. As detailed above, hardening of such ink causes problems in subsequent wipings. To address this drawback, the present embodiment combines wet wiping with double wiping so as to substantially remove ink deposited on a wiper blade after wet wiping.

Figure 19:
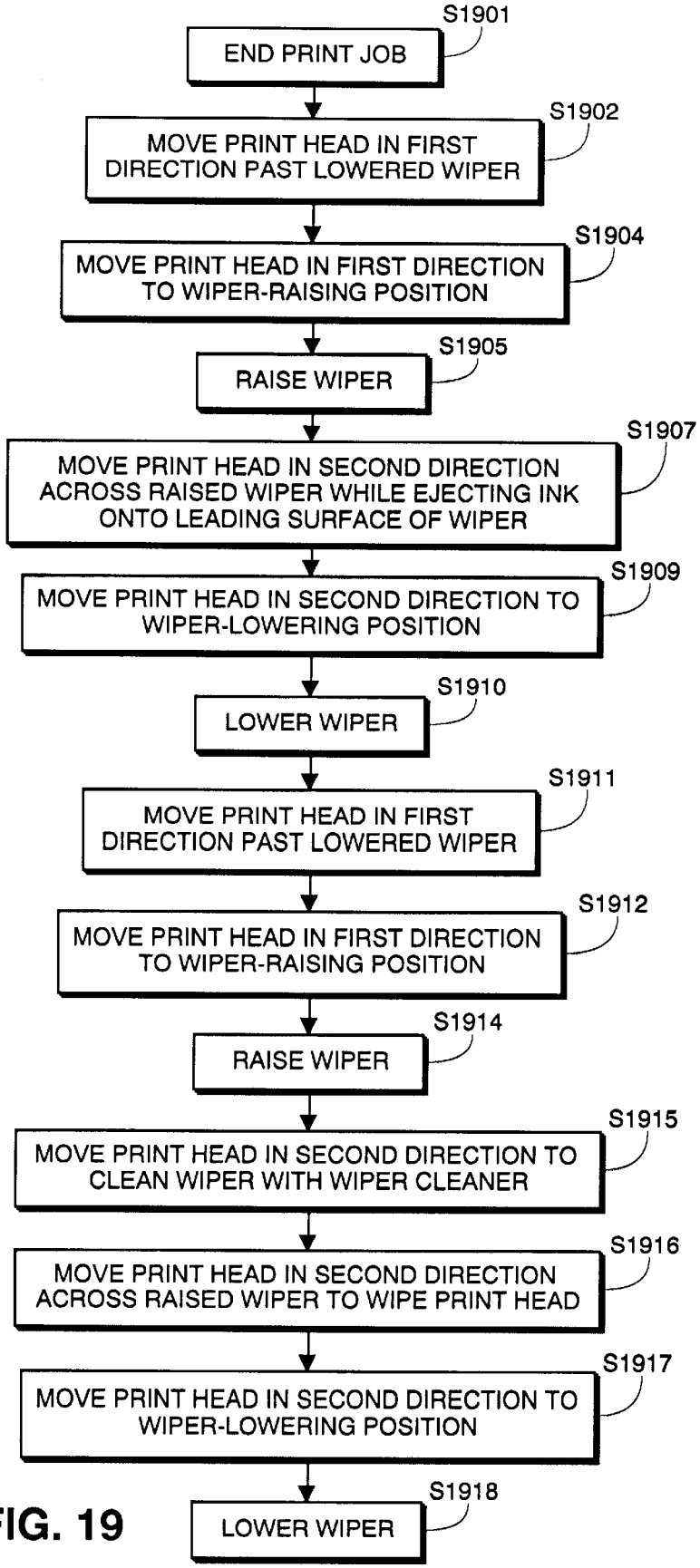
FIG. 19 is a flowchart of process steps to perform a wiping sequence according to the present invention.

FIG. 19 is a flowchart describing process steps to wipe an ink jet print head in accordance with the present embodiment. Preferably, the process steps shown in FIG. 19 are embodied in computer-executable process steps stored on a computer-readable medium and executed by CPU 100 and/or CPU 121.

Briefly, the FIG. 19 process steps include steps to move a print head in a first direction past a lowered wiper, to move the print head in the first direction to a wiper-raising position, to raise the wiper, to move the print head in a second direction opposite to the first direction across the raised wiper while ejecting ink onto the leading surface of the raised wiper, to move the print head in the second direction to a wiper-lowering position and to lower the wiper. The flowchart also includes steps to move the print head in the first direction past the lowered wiper, to move the print head in the first direction to a wiper-raising position, to raise the wiper, to move the print head in the second direction so as to clean the raised wiper with a wiper cleaner and so as to wipe the print head with the raised wiper, to move the print head in the second direction to the wiper-lowering position, and to lower the wiper.

In more detail, flow begins at step S1901, in which a print job ends. Alternatively, step S1901 may represent any other event after which a wiping operation is desired such as, but not limited to, an ejected droplet counter exceeding a threshold value, a printing timer exceeding a threshold value, printer power-off, or the like. Flow then proceeds to steps S1902, S1904, and S1905 as described above with respect to steps S802, S804, and S805 of FIG. 8.

In step S1907, print head 15 is moved in a second direction, opposite to the direction moved in steps S1902 and S1904, across raised wiper blade 30 while ink is ejected onto leading surface 50 of wiper blade 30. In this regard, above-described FIG. 18*a*, FIG. 18*c*, and FIG. 18*d* illustrate step S1907.

Next, steps S1909, S1910, S1911, S1912, S1914, S1915, and S1916 proceed as described above with respect to steps S809 to S816 of FIG. 8 and as shown in FIG. 11*c* to FIG. 11*f*. In particular, the ejected and wiped ink shown deposited on leading surface 50 of wiper blade 30 in FIG. 18*d* is scraped off of wiper blade 30 with wiper cleaner 16 in step S1915. Flow continues through step S1917 and step S1918 as described above with respect to steps S817 and S818.

The foregoing process steps of the present embodiment are amenable to the alterations described above with respect to the first embodiment and also result in at least the advantages also described in conjunction with the first embodiment. In addition, the foregoing process steps provide even better removal of ink from an ink jet print head than the process steps described in relation to the first embodiment.

Sixth Embodiment

A sixth embodiment according to the present invention contemplates combination of wet wiping according to the above-described fourth embodiment and the triple wiping procedure described above with respect to the second embodiment. Such a combination provides the benefits described above with respect to the second embodiment while also providing more effective removal of ink from an ink jet print head by virtue of wet wiping.

Figure 20:
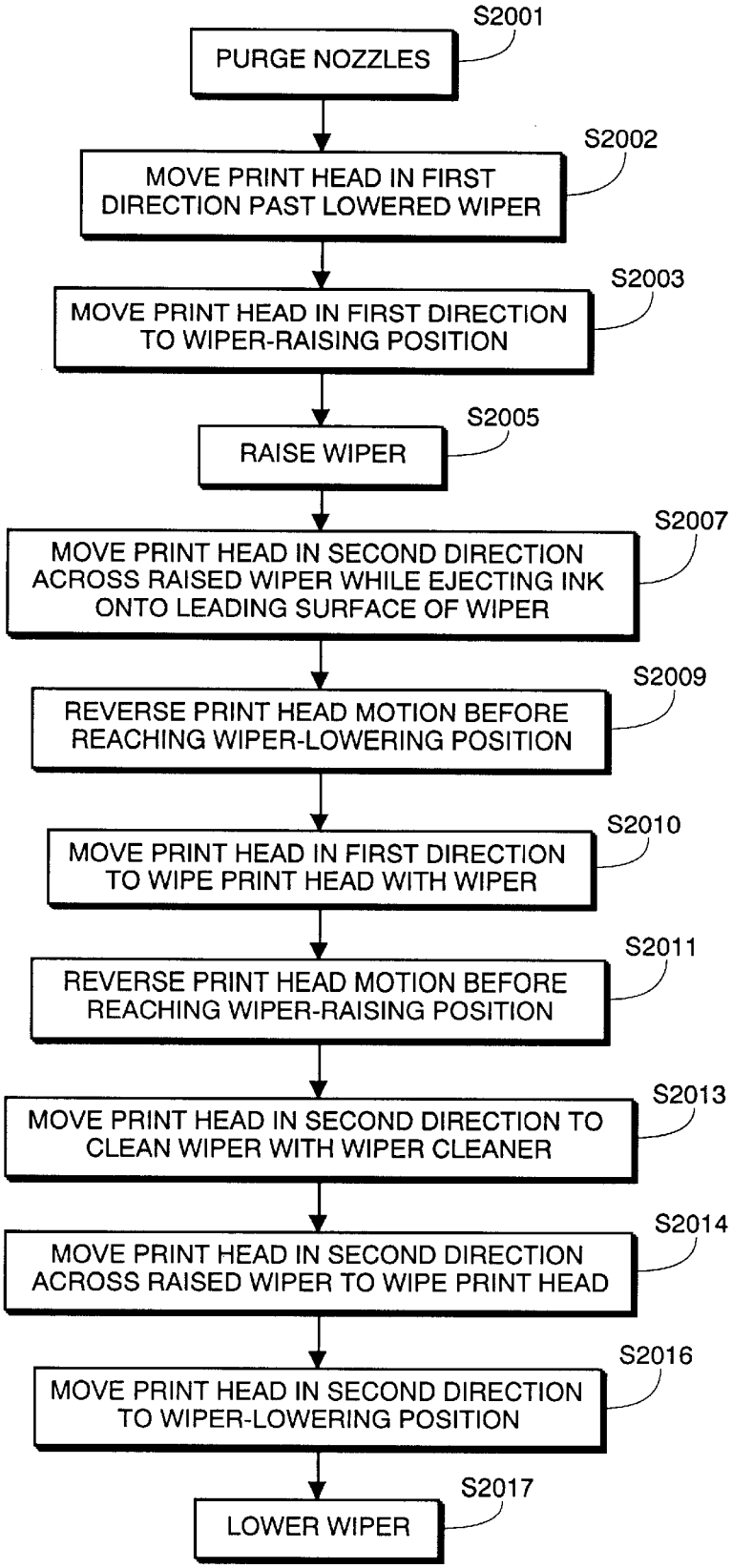
FIG. 20 is a flowchart of process steps to perform a wiping sequence in accordance with the present invention.

FIG. 20 is a flowchart of process steps according to the sixth embodiment of the present invention. These process steps are preferably embodied in computer-executable process steps stored on a computer-readable medium and executed by CPU 100 and/or CPU 121.

Briefly, the FIG. 20 process steps include steps to move a print head in a first direction past a lowered wiper, to move the print head in a first direction to a wiper-raising position, to raise the wiper, and to move the print head in a second direction across the raised wiper while ejecting ink onto a leading surface of the raised wiper. The steps also include steps to reverse print head motion before reaching a wiper-lowering position, to move the print head in the first direction so as to wipe the print head with the raised wiper, to reverse print head motion before reaching the wiper-raising position, to move the print head in the second direction so as to clean the wiper with a wiper cleaner and so as to wipe the print head, to move the print head in the second direction to the wiper-lowering position, and to lower the wiper.

More specifically, the process steps of FIG. 20 are initiated at step S2001, in which ink jet nozzles 14 of print head 15 are purged, thereby causing a significant amount of excess ink to be deposited on the nozzle surface of print head 15. It should be noted that, alternatively, step S2001 may be any event which requires wiping, such as print job end, detection of excess ink on print head 15 or the like.

Steps S2002, S2003, and S2005 proceed similarly to steps S1302, S1303, and S1305 of the FIG. 13 process steps and descriptions thereof are therefore omitted.

In step S2007, print head 15 is moved in the second direction across raised wiper blade 30 while ink is ejected from nozzles 14 onto a leading surface of wiper blade 30. Step S2007 is, like step S1907, illustrated in FIG. 18*a* to FIG. 18*c*. Flow proceeds from step S2007 to step S2009, and therefrom to steps S2010, S2011, S2013, S2014, S2016, and S2017. Steps S2009 to S2017 proceed as described above with respect to steps S1309 to S1317 and illustrated in FIG. 15*a* to FIG. 15*c*, albeit with greater amounts of ink deposited upon both sides of wiper blade 30 due to ink droplets ejected in steps S2007.

By virtue of the foregoing, the present embodiment effectively wipes excess ink from a print head. The present embodiment also provides effective cleaning of a wiping element by cleaning the wiping element before wiped ink is able to harden upon the wiping element. As a result, the effectiveness of subsequent wiping is not reduced due to ink hardened upon the wiping element.

Seventh Embodiment

As discussed above, wet wiping in accordance with the present invention provides effective wiping of an ink jet print head. However, wet wiping as described above requires accurate control of placement of ink droplets upon a flexing wiper blade. In this regard, in a case that ink is ejected on a trailing surface and a top surface of a wiper blade during wet wiping, the wiping system will become contaminated with ink.

It is, however, difficult to control ink ejection during wet wiping so that ejected ink contacts only a leading surface of a wiper blade. This difficulty arises due to variations in wiper blade stiffness caused by age or environmental temperature. In this regard, although the relative position of a wiper holder to an ink jet print head is known, a specific position of a wiper blade cannot be exactly known because the amount of flex experienced by the wiper blade during wiping depends on the varying stiffness of the wiper blade.

As a result of the foregoing, it is preferable, when performing wet wiping as described above, to control ink ejection during wiping in accordance with an environmental temperature or a detected flex of a wiper blade. However, rather than requiring such precise control, the present embodiment merely ejects ink over a longer interval than that described above with respect to wet wiping so as to ensure proper wetting of a wiper blade and a print head. As such, the present embodiment does not attempt to avoid deposition of ink upon a top edge or trailing surface of a wiper.

FIG. 21 illustrates wide interval wet wiping in accordance with the present embodiment. Specifically, FIG. 21*a* shows wiper blade 30 as it begins to move across a nozzle surface of print head 15 at the commencement of a wide interval wet wiping sequence. As shown, nozzles 14 eject ink toward wiper blade 30 at the beginning of wide interval wet wiping. FIG. 21*b* illustrates wide interval wet wiping as an upper part of wiper blade 30 passes nozzles 14. As shown, FIG. 21*a* and FIG. 21*b* closely approximate wet wiping as shown in FIG. 18*a* and FIG. 18*c*.

Figure 21C:
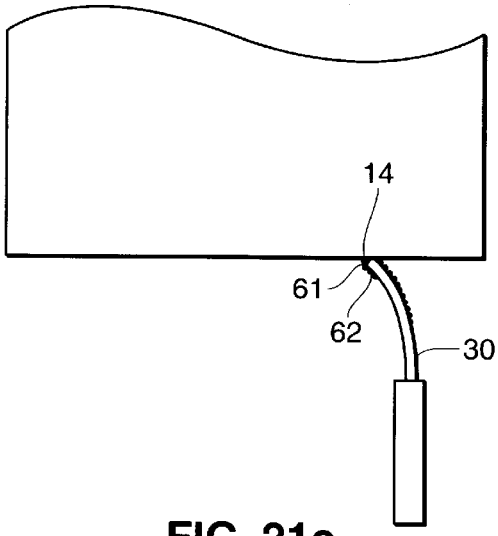

FIG. 21*c* shows wiper blade 30 as top edge 61 passes nozzles 14. As shown, nozzles 14 continue to eject ink upon wiper blade 30 as top edge 61 passes. Accordingly, ejected ink collects on top edge 61 of wiper blade 30 and may also drip down trailing surface 62 of wiper blade 30.

Figure 21D:
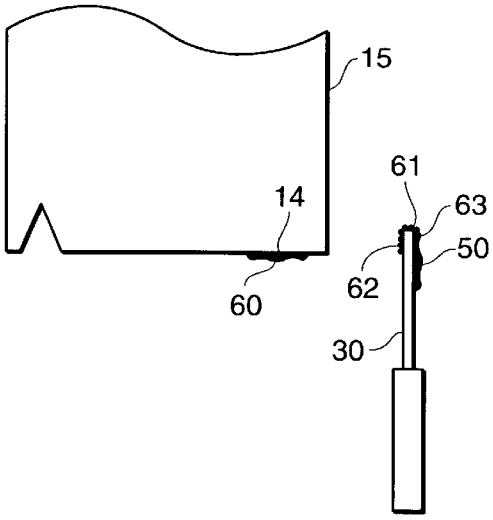

FIG. 21*d* illustrates wiper blade 30 and ink jet print head 15 after completion of wide interval wet wiping. As shown, ink collects upon leading surface 50, top edge 61, and, occasionally, upon trailing surface 62 of wiper blade 30. In addition, excess ink 60 collects nearby nozzles 14 as a result of wide interval wet wiping according to the present invention.

In particular, as top edge 61 of wiper blade 30 passes nozzles 14, ejected ink deflects off of top edge 61 and also deflects off of corner 63 between top edge 61 and leading surface 50. This deflected ink collects on leading region 52 and on portions of trailing region 54 without being wiped by wiper blade 30 during the sequence illustrated in FIG. 21*a* to 21*d*.

As will be described below, excess ink 60 does not significantly degrade printing performance because excess ink 60 is preferably wiped from print head 15 during a reverse-wiping process following the process shown in FIG. 21*a* to FIG. 21*d*. Moreover, the presence of wet excess ink 60 facilitates the reverse-wiping because, as described above, wiping is more effective when performed upon a wet print head than upon a dry print head.

According to an experimentally-derived embodiment, a carriage speed for performing wet wiping is 50 mm/sec and 48 ink droplets are ejected during wet wiping with a frequency of 1 kHz. On the other hand, FIG. 21*e* is a magnified view for describing calculation of wet wiping parameters according to the invention.

Figure 21E:
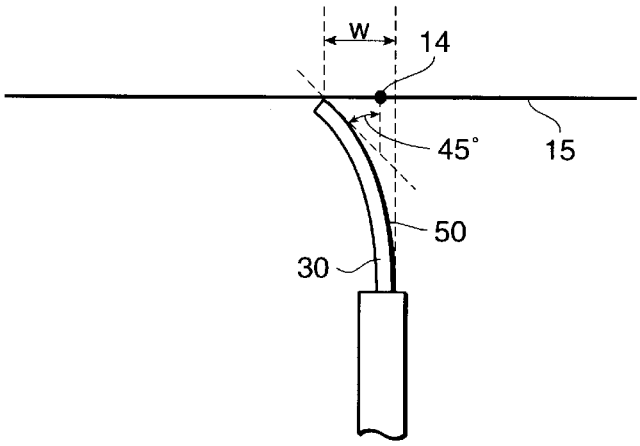

Length w of FIG. 21*e* represents a horizontal region over which ink should be ejected upon wiper blade 30. Accordingly, length w depends upon the length of wiper blade 30, the flexibility of wiper blade 30, and the speed of carriage 21, among other factors. In the experimentally-derived embodiment described above, w=2.4 mm.

In order to calculate wet wiping parameters, it should be understood that it is preferable to eject ink such that droplets which collect on wiper blade 30 contact neighboring droplets. Not only does such contact facilitate wiping by presenting a smooth, wet surface to print head 15, ink ejected in this manner tends to create an ink splash upon hitting wiper blade 30 and a neighboring droplet. As shown in FIG. 18*a* to FIG. 18c, FIG. 21*a*, and FIG. 21*b*, the ink splash collects on print head 15, thereby facilitating wiping of ink from print head 15.

Returning to FIG. 21*e*, in a case that an angle between print head 15 and leading surface 50 of wiper blade 30 is 45°, length w is 2.4 mm, and the droplets to be ejected would connect with neighboring droplets if printed upon a recording medium at 200 dpi, at least 200 dpi×√2×(2.4 mm/25.4 mm/in.)=26 droplets should be ejected upon wiping blade 30 during wiping.

Current print heads are capable of ejecting ink droplets of various sizes. In this regard, ejected droplets are more effectively deflected off wiper blade 30 and onto print head 15 as an ejected droplet size increases. Accordingly, it is preferable to perform wet wiping according to the fourth through eighth embodiments using large ink droplets.

The number of droplets ejected during wet wiping should also be determined so as to avoid waste of ink. In this regard, although wiping effectiveness may improve as a number of droplets ejected increases, the extent of the improvement may not justify the use of the increased number of droplets. Accordingly, the number of droplets ejected during wet wiping, ejecting frequency, and carriage speed should be determined based on both the effectiveness of resulting wet wiping and desired ink conservation.

Although wide interval wet wiping as described above does not require control over ink droplet ejection to the extent required in wet wiping, wide interval wet wiping preferably includes further steps so as to remove ink which collects on top edge 61 and trailing surface 62 of wiper blade 30 during wide interval wet wiping.

Figure 22:
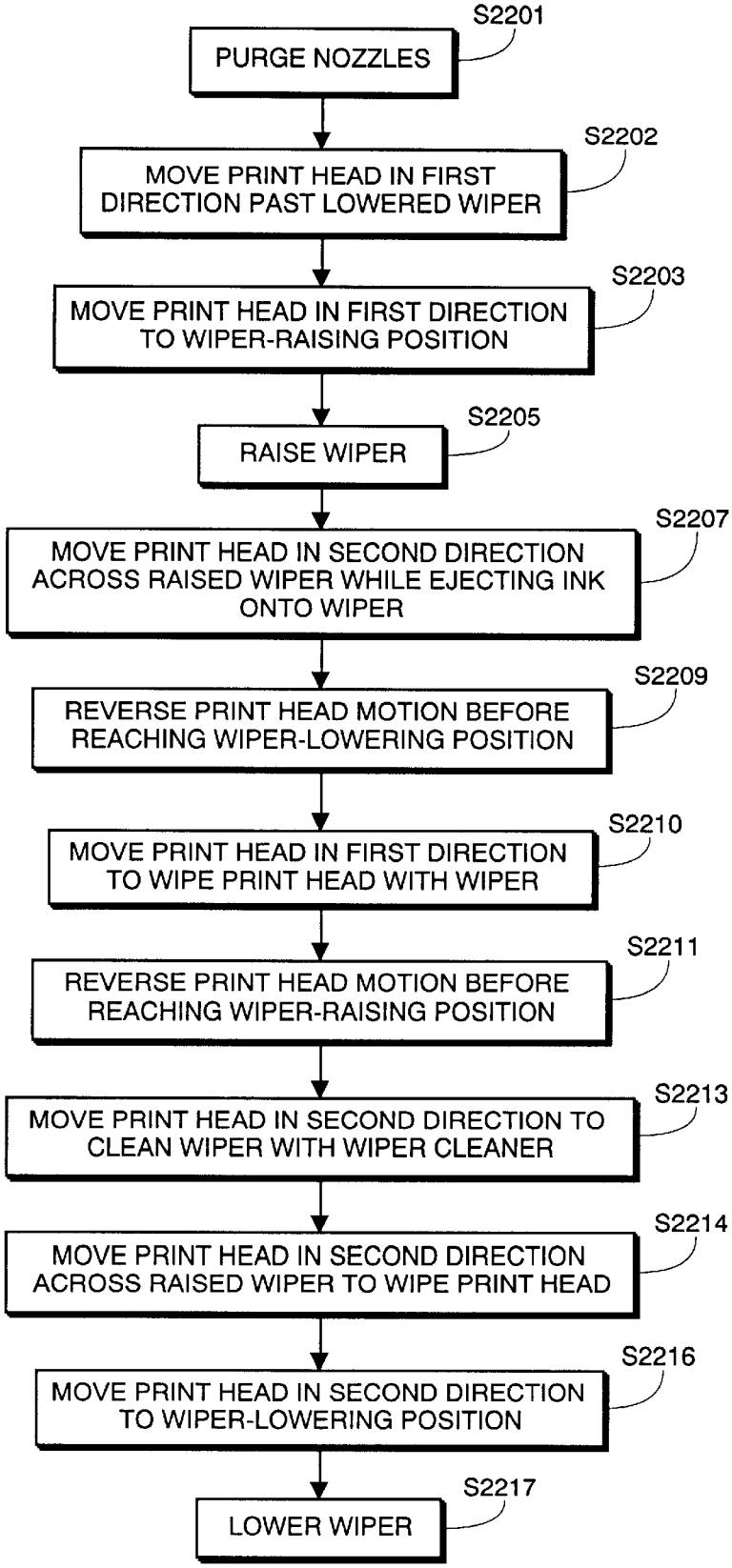
FIG. 22 is a flowchart of process steps to perform a wiping sequence according to the present invention.

In this regard, FIG. 22 is a flowchart of process steps for performing wide interval wet wiping in accordance with the present embodiment. The process steps of FIG. 22 are preferably embodied in computer-executable process steps stored on a computer-readable medium and executed by CPU 100 and/or CPU 121.

Briefly, the process steps of FIG. 22 include steps to move a print head in a first direction past a lowered wiper, to move the print head in the first direction to a wiper-raising position, to raise the wiper, and to move the print head in a second direction across the raised wiper while ejecting ink onto the raised wiper. The steps also include steps to reverse print head motion before reaching a wiper-lowering position, to move the print head in the first direction so as to wipe the print head with the raised wiper, to reverse print head motion before reaching the wiper-raising position, to move the print head in the second direction so as to clean the wiper with a wiper cleaner and so as to wipe the print head, to move the print head in the second direction to the wiper-lowering position, and to lower the wiper.

The FIG. 22 process steps correspond to the FIG. 20 process steps, and descriptions thereof are omitted for the sake of brevity. However, it should be noted, that, in contrast to step S2007 of FIG. 20, S2207 of FIG. 22 includes the steps of wide interval wet wiping described with respect to FIG. 21.

Moreover, in step S2210, ink which collects on top edge 61 and trailing surface 62 of wiper blade 30 is removed by corner 47 of ink jet head 15, shown in FIG. 23*a*. Also during step S2210, and as shown in FIG. 23*b*, ejected ink 60 which collects on ink jet head 15 is preferably transferred to wiper cleaner 16. Of course, ink 65 shown in FIG. 23*b* is then removed, in step S2213, by wiper cleaner 16.

It should be noted that wide interval wet wiping may also be used in conjunction with only process steps S2201 to S2210. Although such a process does not clean ink jet head 15 and wiper blade 30 as effectively as the process of steps S2201 to S2217, process steps S2201 to S2210 advantageously perform wide interval wet wiping and clean trailing surface 62 of wiper blade 30. Accordingly, such a process may be employed in a case where a minimum wiping time is desired.

In this regard, ink ejected onto wiper blade 30 at the point illustrated in FIG. 21*c* remains on print head 15 after step S2207 as excess ink 60 of FIG. 21*d*. As previously explained, excess ink 60 facilitates wiping in step S2210 because excess ink 60 serves to wet print head 15 in preparation for step S2210.

Eighth Embodiment

Although the foregoing describes ink tanks 17 which are removable from print head 15, non-removable ink tanks may also be used in conjunction with the present invention. However, in a case that an ink tank is removed from an ink jet print head, ink surrounding nozzles of the print head hardens more quickly than when an ink tank is attached to the print head. Accordingly, any of the above-described wet wiping systems can be used to wipe the hardened ink from such a print head.

Figure 24:
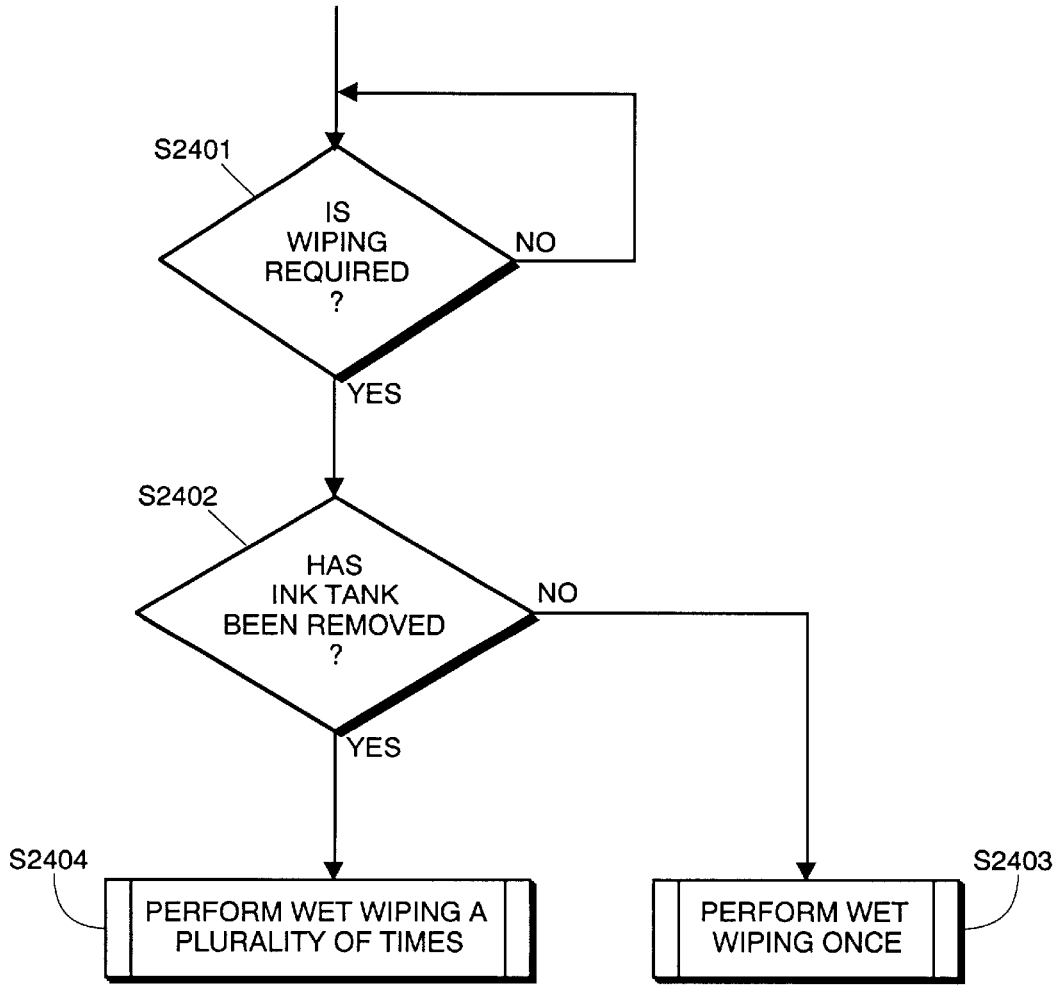
FIG. 24 is a flowchart of process steps to select a number of wet wipings to perform in accordance with the present invention.

In this regard, FIG. 24 is a flowchart of process steps to determine a number of wet wipings to perform in a case that one of ink tanks 17 is removed from print head 15. The FIG. 24 process steps are preferably embodied in computer-executable process steps stored on a computer-readable medium and executed by CPU 100 and/or CPU 121.

Briefly, the FIG. 24 process steps include steps to determine whether wiping is required, to determine whether an ink tank has been replaced, and, if an ink tank has been replaced, to perform wet wiping a plurality of times. If an ink tank has not been replaced, wet wiping is performed once.

Specifically, flow begins at step S2401, in which it is determined if wiping is required. If wiping is not required, flow waits at step S2401. If wiping is required, such as in a case where printer 10 is powered-on, ink is detected on print head 15, a printing time exceeds a threshold value, an ejected droplet counter exceeds a threshold value, or the like, flow continues to step S2402.

In step S2402, it is determined whether ink tank 17 has been replaced. If not, wet wiping according to any of the above-described embodiments is performed once in step S2403. If so, wet wiping is performed a plurality of times in step S2404.

By virtue of the foregoing process steps, the present embodiment provides effective cleaning of an ink jet print head for which an ink tank has been replaced.

Ninth Embodiment

As described in the above Description Of The Related Art, engraved ink jet print heads pose a special wiping problem. As a result, conventional systems are incapable of adequately wiping an engraved ink jet print head.

According to an ninth embodiment of the present invention, a non-planar wiping element is used so as to effectively wipe a grooved nozzle region and ledge regions of an engraved ink jet print head.

FIG. 25 shows representative views of such a non-planar wiper for use in conjunction with the present invention. In particular, FIG. 25*a* shows a front profile of the non-planar, or wave, wiper. As shown in FIG. 25*a*, the front profile of wave wiper 70 is similar to that of wiper 30 of FIG. 10, in that the vertical height of wave wiper 70 is constant along its length.

FIG. 25*b*, however, is a top view of wave wiper 70 and therefore shows a difference between wave wiper 70 and wiper blade 30. Specifically, wave wiper 70 curves outward at its center. As will be described in detail below, this curve enables effective wiping of grooved and ledge regions of an engraved ink jet print head.

Figure 26:
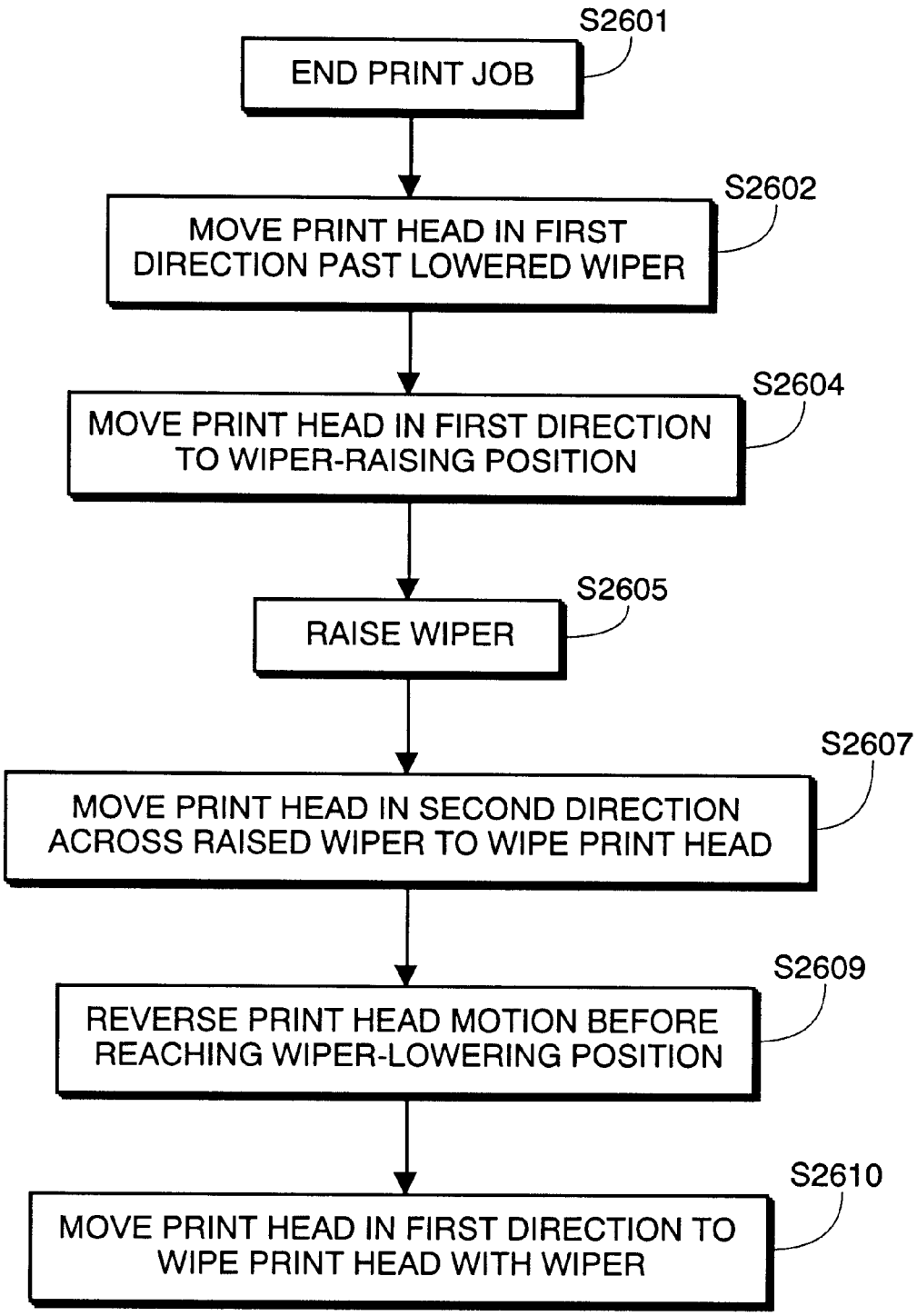
FIG. 26 is a flowchart of process steps to perform wave wiping in accordance with the present invention.

In this regard, FIG. 26 is a flowchart of process steps to wipe an engraved print head according to the ninth embodiment of the present invention. The FIG. 26 process steps are preferably embodied in computer-executable process steps stored on a computer-readable medium and executed by CPU 100 and/or CPU 121.

Briefly, the FIG. 26 process steps include steps to move a print head in a first direction past a lowered wave wiper, to move the print head in the first direction to a wiper-raising position, to raise a wave wiper, to move the print head in a second direction, opposite to the first direction, so as to wipe the print head using a first side of the raised wave wiper, to reverse motion of the print head before reaching a wiper-lowering position, and to move a print head in the first direction so as to wipe the print head with a second side of the raised wave wiper.

More specifically, flow begins at step S2601, at which point a print job has ended. Alternatively, step S2601 may represent any other event which triggers a wiping operation, such as, but not limited to, an ejected droplet counter exceeding a threshold value, printer power-off, or the like. Flow then proceeds to step S2602 and through steps S2604, S2605, and S2607 as described above with respect to steps S1302, S1303, S1305, and S1307. Accordingly, specific discussions of those steps are omitted herein for the sake of brevity.

Figure 27:
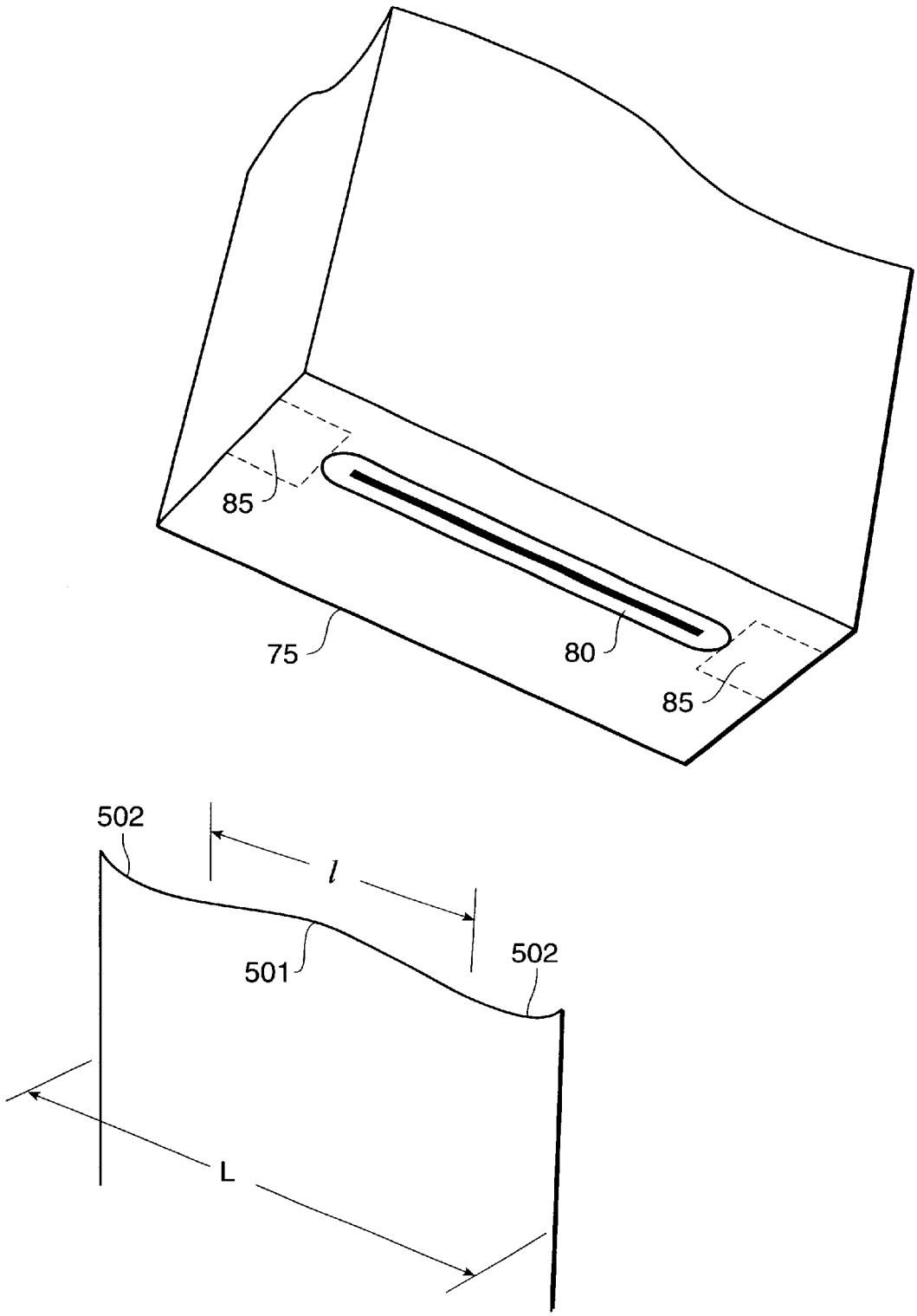
FIG. 27 illustrates forward wave wiping according to the present invention.

FIG. 27 is a view illustrating wiping occurring during step S2607. As shown, curved center portion 501 of wave wiper 70 initially contacts print head 75 due to the right-to-left motion of print head 75. Next, curved center portion 501 contacts grooved nozzle region 80 of print head 75.

Preferably, length l of center portion 501 roughly corresponds to the length of grooved nozzle region 80, so as to most effectively wipe nozzle region 80. In this regard, length L of wave wiper 70 preferably exceeds the length of print head 75. Moreover, the dimensions of edges 502 should be such that edges 502 contact ledges 85 of print head 75, shown by dotted areas in FIG. 27.

Although the shape of wave wiper 70 enables effective wiping of region 80, pressure placed by edges 502 upon ledges 85 during step S2607 is inadequate to effectively wipe ledges 85. Accordingly, residual ink often remains in "channels" close to the boundary between ledges 85 and nozzle region 80 after step S2607.

Returning to the FIG. 26 process steps, flow proceeds from step S2607 to step S2609, wherein motion of print head 75 is reversed while wave wiper 70 remains raised. Next, in step S2610, print head 75 is moved in the reversed direction so as to again wipe print head 75 with wave wiper 70.

Figures 28, 28A:
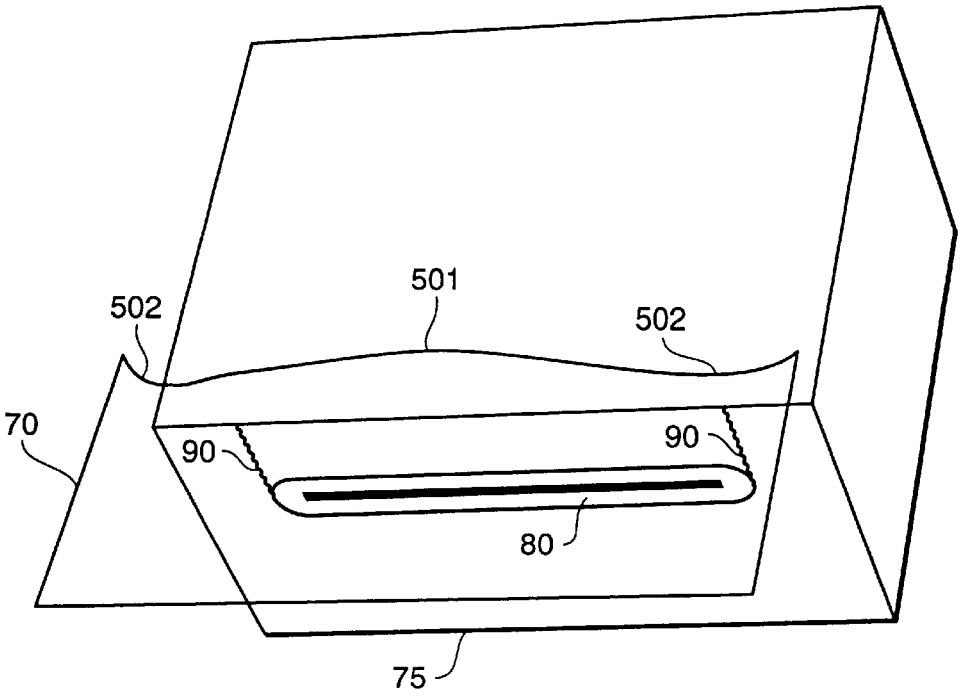
FIG. 28, comprising
FIG. 28*a* and FIG. 28*b*, illustrates backward wave wiping according to the present invention.
Figure 28B:
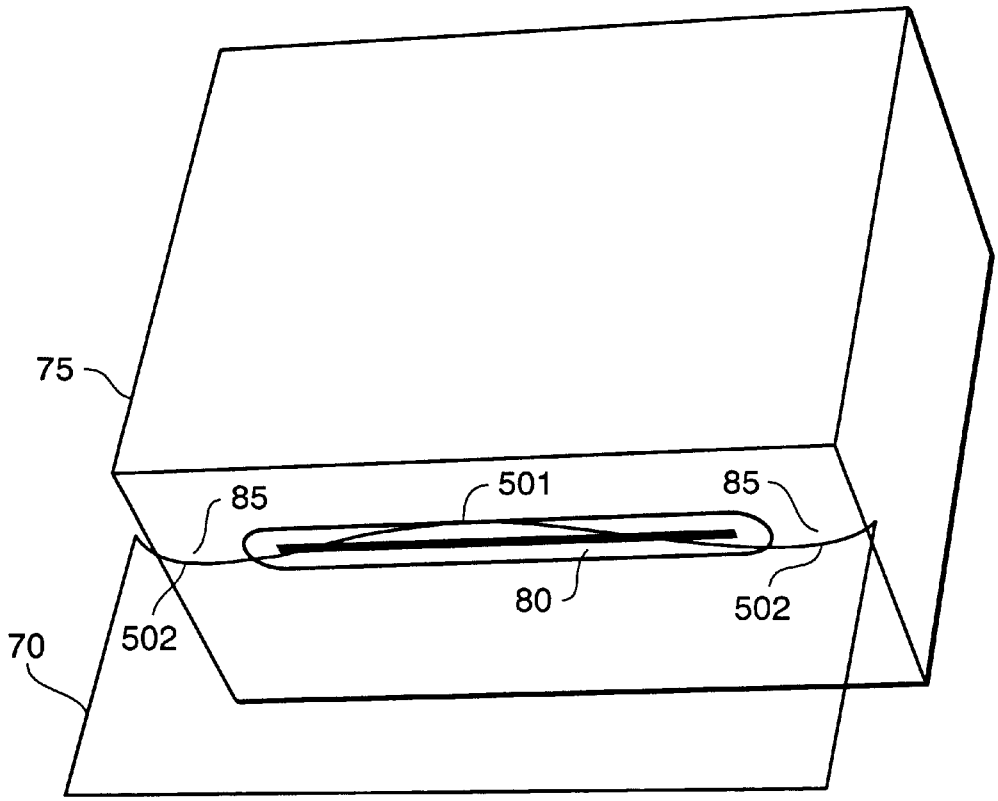

FIG. 28*a* and FIG. 28*b* illustrate wiping according to step S2610. In this regard, FIG. 28*a* shows print head 75 about to encounter wave wiper 70 due to the left-to-right motion of print head 75. As shown, edges 502 initially contact print head 75. Also shown in FIG. 28*a* are residual ink channels 90 remaining after wiping according to step S2607.

During wiping, although center portion 501 does not significantly contact nozzle region 80, the shape of wave wiper 70 causes edges 502 to firmly engage ledges 85 of print head 75. Accordingly, as shown in FIG. 28*b*, ink channels 90 are effectively removed from print head 75.

Figure 29:
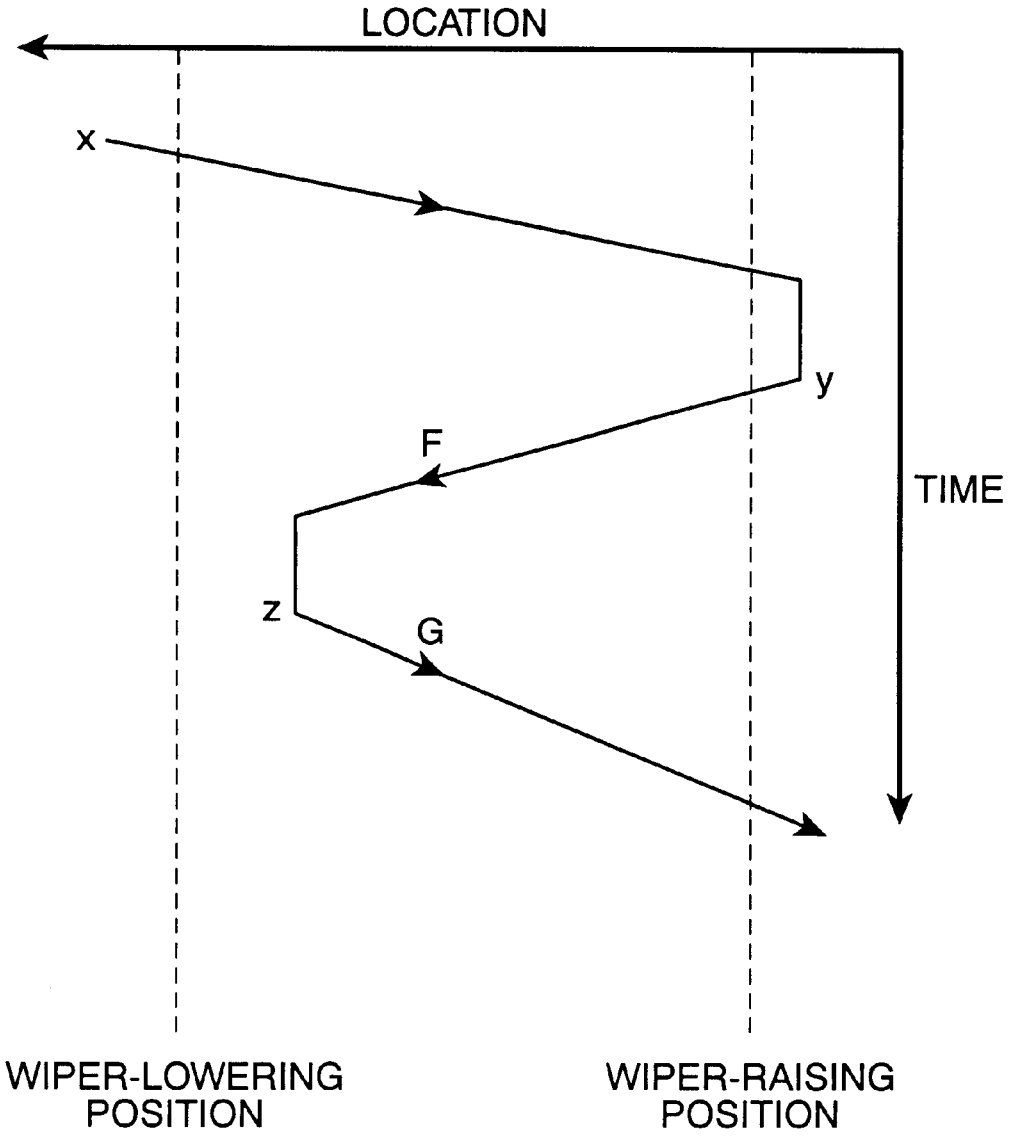
FIG. 29 is a diagram illustrating relative positions of an ink jet print head over time during a wiping sequence according to the present invention.

FIG. 29 is a diagram illustrating a path taken by a print head according to the FIG. 26 process steps. In this regard, path x is traversed during steps S2601 to S2605, and path y is travelled during steps S2607 and S2609, with wiping occurring at location F. In addition, path z is traversed during step S2610, with reverse wiping occurring at location G.

It should be noted that the particular shape of the wave wiper disclosed herein is merely representative of a wave wiper suitable for use with the present invention. Accordingly, the invention may be practiced in conjunction with any wave wiper having the relevant characteristics of the wave wiper disclosed herein.

Moreover, a wave wiper may be used as a wiping element in any of embodiments one through eight in accordance with the present invention.

In each of the above embodiments, either dye or pigment ink may be used. However, the above embodiments are especially advantageous when used in conjunction with pigment ink, since pigment ink is particularly difficult to wipe from a print head or wiping element once hardened.

While the present invention is described above with respect to what is currently considered its preferred embodiments, it is to be understood that the invention is not limited to that described above. To the contrary, the invention is intended to cover various modifications and equivalent arrangements included within the spirit and scope of the appended claims.

What is claimed is:

1. A method for performing a wiping operation upon an ink jet print head, the method comprising the steps of:

a first moving step of moving the ink jet print head in a first direction to wipe the ink jet print head against a wiping element; and a second moving step of moving the ink jet print head in the first direction to wipe the ink jet print head against the wiping element.

2. A method according to claim 1, further comprising a third moving step of moving the ink jet print head in a second direction opposite to the first direction between said first and second moving steps to wipe the ink jet print head against the wiping element.

3. A method for wiping an ink jet print head, the method comprising the steps of:

a first moving step of moving the ink jet print head in a first direction against a wiping element to wipe the ink jet print head; and an ejecting step of ejecting ink toward the wiping element during said first moving step, wherein the ink adheres to the wiping element and the print head while said wiping element is in contact with said print head.

4. A method according to claim 3, wherein ink ejected toward the wiping element deflects off of the wiping element and collects on the ink jet print head.

5. A method according to claim 3, further comprising controlling said ejecting step based upon a shape of the wiping element during said first moving step.

6. A method according to claim 3, further comprising ejecting ink toward a top edge of the wiper element during said first moving step.

7. A method according to claim 6, further comprising a second moving step of moving the ink jet print head in a second direction opposite to the first direction to wipe the ink jet print head against the wiping element.

8. A method according to claim 7, further comprising a third moving step of moving the ink jet print head in the first direction to wipe the ink jet print head against a wiping element.

9. A method according to claim 3, wherein said ink jet print head ejects pigment ink.

10. A method according to claim 9, wherein the ejected pigment ink is contained within an ink tank, the ink tank being removable from the print head.

11. A method according to claim 10, further comprising:

determining whether the ink tank is removed from the print head, wherein said first moving step and said ejecting step are repeated based on whether the ink tank is removed from the print head.

12. A method according to claim 3, wherein the wiping element is a wave wiper.

13. A method according to claim 3, wherein the wiping element is aligned substantially parallel to a plurality of nozzles of the ink jet print head.

14. A method according to claim 3, wherein said ink jet print head is capable of ejecting ink droplets having a plurality of sizes including a largest size, and wherein ink droplets of the largest size are ejected toward the wiping element during said first moving step.

15. A method for wiping an ink jet print head in a printing apparatus, the method comprising the steps of:

setting a wiping mode in the printing apparatus; and determining a wiping procedure based on the set wiping mode, wherein a first wiping mode comprises a different wiping sequence than a second wiping mode.

16. A computer-readable medium storing computer-executable process steps to perform a wiping operation upon an ink jet print head, the steps comprising:

a first moving step to move the ink jet print head in a first direction to wipe the ink jet print head against a wiping element; and a second moving step to move the ink jet print head in the first direction to wipe the ink jet print head against the wiping element.

17. A computer-readable medium according to claim 16, further comprising a third moving step to move the ink jet print head in a second direction opposite to the first direction between said first and second moving steps to wipe the ink jet print head against the wiping element.

18. A computer-readable medium storing computer-executable process steps to wipe an ink jet print head, the steps comprising:

a first moving step to move the ink jet print head in a first direction against a wiping element to wipe the ink jet print head; and an ejecting step to eject ink toward the wiping element during said first moving step, wherein the ink adheres to the wiping element and the print head while said wiping element is in contact with said print head.

19. A computer-readable medium according to claim 18, wherein ink ejected toward the wiping element deflects off of the wiping element and collects on the ink jet print head.

20. A computer-readable medium according to claim 18, further comprising a controlling step to control said ejecting step based upon a shape of the wiping element during said first moving step.

21. A computer-readable medium according to claim 18, further comprising an ejecting step to eject ink toward a top edge of the wiper element during said first moving step.

22. A computer-readable medium according to claim 21, further comprising a second moving step to move the ink jet print head in a second direction opposite to the first direction to wipe the ink jet print head against the wiping element.

23. A computer-readable medium according to claim 22, further comprising a third moving step to move the ink jet print head in the first direction to wipe the ink jet print head against a wiping element.

24. A computer-readable medium according to claim 18, wherein said ink jet print head ejects pigment ink.

25. A computer-readable medium according to claim 24, wherein the ejected pigment ink is contained within an ink tank, the ink tank being removable from the print head.

26. A computer-readable medium according to claim 25, the process steps further comprising:

a determining step to determine whether the ink tank is removed from the print head, wherein said first moving step and said ejecting step are repeated based on whether the ink tank is removed from the print head.

27. A computer-readable medium according to claim 18, wherein the wiping element is a wave wiper.

28. A computer-readable medium according to claim 18, wherein the wiping element is aligned substantially parallel to a plurality of nozzles of the ink jet print head.

29. A computer-readable medium according to claim 18, wherein said ink jet print head is capable of ejecting ink droplets having a plurality of sizes including a largest size, and wherein ink droplets of the largest size are ejected toward the wiping element during said first moving step.

30. A computer-readable medium storing computer-executable process steps to wipe an ink jet print head in a printing apparatus, the steps comprising:

a setting step to set a wiping mode in the printing apparatus; and a determining step to determine a wiping procedure based on the set wiping mode, wherein a first wiping mode comprises a different wiping sequence than a second wiping mode.

31. A method for wiping an ink jet print head, comprising:

moving the ink jet print head in a first direction past a raised wiping element so as to wipe the print head with the raised wiping element;

lowering the wiping element;

moving the ink jet print head in a second direction, opposite to the first direction, past the lowered wiping element;

raising the wiping element; and moving the ink jet print head in the first direction past the raised wiping element so as to clean the wiping element with a wiping element cleaner connected to the print head and to wipe the print head with the raised wiping element.

32. A method for wiping an ink jet print head, comprising:

moving the ink jet print head in a first direction past a raised wiping element so as to wipe the print head with the raised wiping element;

moving the ink jet print head in the first direction to a wiper-lowering position;

lowering the wiping element;

moving the ink jet print head in a second direction, opposite to the first direction, past the lowered wiping element to a wiper-raising position;

raising the wiping element; and moving the ink jet print head in the first direction past the raised wiping element so as to clean the wiping element with a wiping element cleaner connected to the print head and to wipe the print head with the raised wiping element.

33. A computer-readable medium storing computer-executable process steps to wipe an ink jet print head, the process steps comprising:

a moving step to move the ink jet print head in a first direction past a raised wiping element so as to wipe the print head with the raised wiping element;

a lowering step to lower the wiping element;

a moving step to move the ink jet print head in a second direction, opposite to the first direction, past the lowered wiping element;

a raising step to raise the wiping element; and a moving step to move the ink jet print head in the first direction past the raised wiping element so as to clean the wiping element with a wiping element cleaner connected to the print head and to wipe the print head with the raised wiping element.

34. A computer-readable medium storing computer-executable process steps to wipe an ink jet print head, the process steps comprising:

a moving step to move the ink jet print head in a first direction past a raised wiping element so as to wipe the print head with the raised wiping element;

a moving step to move the ink jet print head in the first direction to a wiper-lowering position;

a lowering step to lower the wiping element;

a moving step to move the ink jet print head in a second direction, opposite to the first direction, past the lowered wiping element to a wiper-raising position;

a raising step to raise the wiping element; and a moving step to move the ink jet print head in the first direction past the raised wiping element so as to clean the wiping element with a wiping element cleaner connected to the print head and to wipe the print head with the raised wiping element.

35. An ink jet printer comprising:

an ink jet print head;

a wiping element for wiping said ink jet print head, said wiping element movable between a raised position and a lowered position;

a wiping element cleaner for cleaning said wiping element;

a carriage for holding said ink jet print head;

means for moving the carriage relative to the wiping element; and means for raising the wiping element to the raised position, wherein said wiping element is raised by said means for raising, said carriage is moved by said means for moving in a first direction past the raised wiping element so as to wipe said print head with the raised wiping element, said carriage is moved by said means for moving in the first direction to a wiper-lowering position, said wiping element is lowered by said means for lowering, said carriage is moved by said means for moving in a second direction, opposite to the first direction, past the lowered wiping element to a wiper-raising position, said wiping element is raised by said means for raising, and said carriage is moved by said means for moving in the first direction past the raised wiping element so as to clean said wiping element with said wiping element cleaner and to wipe said print head with the raised wiping element.

36. A method for wiping an ink jet print head, comprising:

moving the ink jet print head in a first direction past a raised wiping element so as to wipe the print head with the raised wiping element;

moving the ink jet print head in a second direction, opposite to the first direction, past the raised wiping element so as to wipe the ink jet print head with the raised wiping element; and moving the ink jet print head in the first direction past the raised wiping element so as to clean the wiping element with a wiping element cleaner connected to the print head and to wipe the print head with the raised wiping element.

37. A method according to claim 36, further comprising purging ink from nozzles of the ink jet print head.

38. A method for wiping an ink jet print head, comprising:

moving the ink jet print head in a first direction past a raised wiping element so as to wipe the print head with the raised wiping element;

moving the ink jet print head in a second direction, opposite to the first direction, past the raised wiping element so as to wipe the ink jet print head with the raised wiping element; and moving the ink jet print head in the first direction past the raised wiping element so as to clean the wiping element with a wiping element cleaner connected to the print head and to wipe the print head with the raised wiping element.

39. A method according to claim 38, further comprising purging ink from nozzles of the ink jet print head.

40. A computer-readable medium storing computer-executable process steps to wipe an ink jet print head, the process steps comprising:

a moving step to move the ink jet print head in a first direction past a raised wiping element so as to wipe the print head with the raised wiping element;

a moving step to move the ink jet print head in a second direction, opposite to the first direction, past the raised wiping element so as to wipe the ink jet print head with the raised wiping element; and a moving step to move the ink jet print head in the first direction past the raised wiping element so as to clean the wiping element with a wiping element cleaner connected to the print head and to wipe the print head with the raised wiping element.

41. A computer-readable medium according to claim 40, the process steps further comprising a purging step to purge ink from nozzles of the ink jet print head.

42. A computer-readable medium storing computer-executable process steps to wipe an ink jet print head, the process steps comprising:

a moving step to move the ink jet print head in a first direction past a raised wiping element so as to wipe the print head with the raised wiping element;

a moving step to move the ink jet print head in a second direction, opposite to the first direction, past the raised wiping element so as to wipe the ink jet print head with the raised wiping element; and a moving step to move the ink jet print head in the first direction past the raised wiping element so as to clean the wiping element with a wiping element cleaner connected to the print head and to wipe the print head with the raised wiping element.

43. A computer-readable medium according to claim 42, the process steps further comprising a purging step to purge ink from nozzles of the ink jet print head.

44. An ink jet printer comprising:

an ink jet print head;

a wiping element for wiping said ink jet print head, said wiping element movable between a raised position and a lowered position;

a wiping element cleaner for cleaning said wiping element;

a carriage for holding said ink jet print head;

means for moving the carriage relative to the wiping element; and means for raising the wiping element to the raised position, wherein said wiping element is raised by said raising means, said carriage is moved by said means for moving in a first direction past the raised wiping element so as to wipe said print head with the raised wiping element, said carriage is moved by said means for moving in a second direction, opposite to the first direction, past the raised wiping element so as to wipe said print head with the raised wiping element, and said carriage is moved by said means for moving in the first direction past the raised wiping element so as to clean said wiping element with said wiping element cleaner and to wipe said print head with the raised wiping element.

45. A method for wiping an engraved ink jet print head having ink jet nozzle openings disposed in a groove within a face of the ink jet print head, comprising:

moving the ink jet print head in a first direction past a raised non-planar wiper so as to wipe the print head with a first side of the raised non-planar wiper; and moving the ink jet print head in a second direction, opposite to the first direction, past the raised non-planar wiper so as to wipe the ink jet print head with a second side of the raised non-planar wiper.

46. A computer-readable medium storing computer-executable process steps to wipe an engraved ink jet print head having ink jet nozzle openings disposed in a groove within a face of the ink jet print head, the process steps comprising:

a moving step to move the ink jet print head in a first direction past a raised non-planar wiper so as to wipe the print head with a first side of the raised non-planar wiper; and a moving step to move the ink jet print head in a second direction, opposite to the first direction, past the raised non-planar wiper so as to wipe the ink jet print head with a second side of the raised non-planar wiper.

47. An ink jet printer comprising:

an engraved ink jet print head having ink jet nozzle openings disposed in a groove within a face of the ink jet print head;

a non-planar wiper for wiping said ink jet print head, said non-planar wiper movable between a raised position and a lowered position;

a carriage for holding said ink jet print head;

means for moving the carriage relative to the non-planar wiper; and means for raising the non-planar wiper to the raised position, wherein said non-planar wiper is raised by said raising means, said carriage is moved by said means for moving in a first direction past the raised non-planar wiper so as to wipe said print head with a first side of the raised non-planar wiper, and said carriage is moved by said means for moving in a second direction, opposite to the first direction, past the raised non-planar wiper so as to wipe said print head with a second side of the raised non-planar wiper.

48. A method for wiping an ink jet print head, the method comprising the steps of:

a first moving step of moving the ink jet print head in a first direction against a wiping element to wipe the ink jet print head; and an ejecting step of ejecting ink toward the wiping element during said first moving step, wherein the ejection of ink is controlled based upon a shape of the wiping element.

49. A method for wiping an ink jet print head, the method comprising the steps of:

a first moving step of moving the ink jet print head in a first direction against a wiping element to wipe the ink jet print head; and an ejecting step of ejecting ink toward the wiping element during said first moving step, wherein the ink is ejected toward a top edge of the wiping element.

50. A method according to claim 49, further comprising a second moving step of moving the ink jet print head in a second direction opposite to the first direction to wipe the ink jet print head against the wiping element.

51. A method according to claim 50, further comprising a third moving step of moving the ink jet print head in the first direction to wipe the ink jet print head against a wiping element.

52. A method for wiping an ink jet head print head, the method comprising the steps of:

a first moving step of moving the ink jet print head in a first direction against a wiping element to wipe the ink jet print head; and an ejecting step of ejecting ink toward the wiping element during said first moving step, wherein said ink jet print head is capable of ejecting ink droplets having a plurality of sizes including a largest size, and wherein ink droplets of the largest size are ejected toward the wiping element during the first moving step.

53. A computer-readable medium storing computer-executable process steps to wipe an ink jet print head, the steps comprising:

a first moving step to move the ink jet print head in a first direction against a wiping element to wipe the ink jet print head; and an ejecting step to eject ink toward the wiping element during said first moving step, wherein said ejecting step is controlled to eject ink based upon a shape of the wiping element.

54. A computer-readable medium storing computer-executable process steps to wipe an ink jet print head, the steps comprising:

a first moving step to move the ink jet print head in a first direction against a wiping element to wipe the ink jet print head; and an ejecting step to eject ink toward the wiping element during said first moving step, wherein ink is ejected toward a top edge of the wiping element.

55. A computer-readable medium according to claim 54, further comprising a second moving step to move the ink jet print head in a second direction opposite to the first direction to wipe the ink jet print head against the wiping element.

56. A computer-readable medium according to claim 55, further comprising a third moving step to move the ink jet print head in the first direction to wipe the ink jet print head against a wiping element.

57. A computer-readable medium storing computer-executable process steps to wipe an ink jet print head, the he steps comprising:

a first moving step to move the ink jet print head in a first direction against a wiping element to wipe the ink jet print head; and an ejecting step to eject ink toward the wiping element during said first moving step, wherein said ink jet print head is capable of ejecting ink droplets having a plurality of sizes including a largest size, and wherein ink droplets of the largest size are ejected toward the wiping element during said first moving step.

* * * * *

UNITED STATES PATENT AND TRADEMARK OFFICE

CERTIFICATE OF CORRECTION

PATENT NO. : 6,244,685 B1
DATED : June 12, 2001
INVENTOR(S) : Yamada et al.

It is certified that error appears in the above-identified patent and that said Letters Patent is hereby corrected as shown below:

Column 2,
Line 35, "address" should read -- addresses --.

Column 3,
Line 30, "an" should read -- a --.

Column 7,
Line 36, "Of the" should read -- of the --.

Column 18,
Line 35, "Of the" should read -- of the --; and
Line 39, "an" should read -- a --.

Column 26,
Line 9, "head" (first occurrence) shoud be deleted; and
Line 52, "he" should be deleted.

Signed and Sealed this

Fourteenth Day of May, 2002

*Attest:*

*Attesting Officer*

JAMES E. ROGAN
*Director of the United States Patent and Trademark Office*